US009042558B2

(12) United States Patent
Takada

(10) Patent No.: US 9,042,558 B2
(45) Date of Patent: May 26, 2015

(54) DECODING APPARATUS, DECODING METHOD, ENCODING APPARATUS, ENCODING METHOD, AND EDITING APPARATUS

(75) Inventor: Yousuke Takada, Kobe (JP)

(73) Assignee: GVBB Holdings S.A.R.L., Luxembourg (LU)

( * ) Notice: Subject to any disclaimer, the term of this patent is extended or adjusted under 35 U.S.C. 154(b) by 523 days.

(21) Appl. No.: 13/122,143

(22) PCT Filed: Oct. 1, 2008

(86) PCT No.: PCT/JP2008/068258

§ 371 (c)(1),
(2), (4) Date: Mar. 31, 2011

(87) PCT Pub. No.: WO2010/038318

PCT Pub. Date: Apr. 8, 2010

(65) Prior Publication Data

US 2011/0182433 A1 Jul. 28, 2011

(51) Int. Cl.

| | |
|---|---|
| ***H04R 5/00*** | (2006.01) |
| ***G10L 19/022*** | (2013.01) |
| ***G10L 19/008*** | (2013.01) |

(52) U.S. Cl.

CPC ..... *G10L 19/022* (2013.01); *G10L 19/008* (2013.01); *H04S 2400/03* (2013.01)

(58) Field of Classification Search

CPC .. G10L 19/022; G10L 19/008; H04S 2400/03
USPC ..... 381/19–23; 704/500–504
See application file for complete search history.

(56) References Cited

U.S. PATENT DOCUMENTS 5,867,819 A * 2/1999 Fukuchi et al. ..... 704/500

(Continued)

FOREIGN PATENT DOCUMENTS

| | | |
|---|---|---|
| CN | 1930914 A | 3/2007 |
| EP | 1381254 | 1/2004 |

(Continued)

OTHER PUBLICATIONS

Office Action in Chinese Patent Application No. 200880132173.1 mailed Apr. 1, 2012.
Office Action in Chinese Patent Application No. 200880132173.1 mailed Aug. 3, 2012.

(Continued)

*Primary Examiner* — Davetta W Goins
*Assistant Examiner* — Oyesola C Ojo
(74) *Attorney, Agent, or Firm* — Arent Fox LLP

(57) ABSTRACT

A decoding apparatus (10) is disclosed which includes: a storing means (11) for storing encoded audio signals including multi-channel audio signals; a transforming means (40) for transforming the encoded audio signals to generate transform block-based audio signals in a time domain; a window processing means (41) for multiplying the transform block-based audio signals by a product of a mixture ratio of the audio signals and a first window function, the product being a second window function; a synthesizing means (43) for overlapping the multiplied transform block-based audio signals to synthesize audio signals of respective channels; and a mixing means (14) for mixing audio signals of the respective channels between the channels to generate a downmixed audio signal. Furthermore, an encoding apparatus is also disclosed which downmixes the multi-channel audio signals, encodes the downmixed audio signals, and generates the encoded, downmixed audio signals.

17 Claims, 16 Drawing Sheets

(56) References Cited

U.S. PATENT DOCUMENTS

| | | | | |
|---|---|---|---|---|
| 5,946,352 | A * | 8/1999 | Rowlands et al. | 375/242 |
| 6,122,619 | A | 9/2000 | Kolluru et al. | |
| 6,128,597 | A * | 10/2000 | Kolluru et al. | 704/500 |
| 6,141,645 | A * | 10/2000 | Chi-Min et al. | 704/500 |
| 7,330,555 | B2 * | 2/2008 | Suzuki | 381/119 |
| 7,689,428 | B2 * | 3/2010 | Takagi et al. | 381/22 |
| 8,270,618 | B2 * | 9/2012 | Herre et al. | 381/23 |
| 2009/0161795 | A1 * | 6/2009 | Oh et al. | 375/316 |

FOREIGN PATENT DOCUMENTS

| | | | |
|---|---|---|---|
| JP | 6165079 | A | 6/1994 |
| JP | 9252254 | A | 9/1997 |
| JP | 11145844 | A | 5/1999 |
| JP | 2004109362 | A | 4/2004 |
| JP | 2004361731 | A | 12/2004 |
| JP | 2008505368 | A | 2/2008 |
| JP | 2008053839 | A | 3/2008 |
| JP | 2008236384 | A | 10/2008 |
| WO | 2007096808 | A1 | 8/2007 |

OTHER PUBLICATIONS

Abel, James C., et al. "Improving Execution Time", IEEE Signal Processing Magazine, Piscataway, NJ, vol. 17, No. 2, Mar. 1, 2000, pp. 36-42, XP011089858.

Breebaart, J., et al. "Multi-channel goes mobile: MPEG surround binaural rendering" AES International Conference, Audio for Mobile and Handheld Devices, Sep. 2, 2006, (pp. 1-13, XP007902577.

Szczerba M., et al., "Matrixed multi-channel extension for AAC codec", Audio Engineering Society Convention Paper, New York, NY, No. 5796, Mar. 22, 2003, pp. 1-9, XP002363660.

International Search Report for International Application No. PCT/JP2008/068258, mailed May 18, 2009, 4 pages.

Office Action for Japanese Patent Application No. 2011-514573 issued by the JPO on Jan. 22, 2013.

Office Action for Chinese Patent Application No. 200880132173.1 issued by the SIPO on Jan. 4, 2013.

Decision of Refusal dated Oct. 15, 2013 regarding Japanese Patent Application No. JP2011-514573.

IPRP dated Apr. 5, 2011 with Written Opinion regarding PCT Patent Application No. PCT/JP2008/068258.

EP Communication dated Mar. 13, 2015, regarding EP08876189.5.

* cited by examiner

*FIG. 6A*

| | | | | | | |
|---|---|---|---|---|---|---|
| $\alpha W_0$ | $\alpha W_1$ | $\alpha W_2$ | ------ | $\alpha W_m$ | ------ | $\alpha W_{N-1}$ |

*FIG. 6B*

| | | | | | | |
|---|---|---|---|---|---|---|
| $\beta W_0$ | $\beta W_1$ | $\beta W_2$ | ------ | $\beta W_m$ | ------ | $\beta W_{N-1}$ |

*FIG. 6C*

| | | | | | | |
|---|---|---|---|---|---|---|
| $\delta W_0$ | $\delta W_1$ | $\delta W_2$ | ------ | $\delta W_m$ | ------ | $\delta W_{N-1}$ |

DECODING APPARATUS, DECODING METHOD, ENCODING APPARATUS, ENCODING METHOD, AND EDITING APPARATUS

CROSS-REFERENCE TO RELATED APPLICATIONS

This application is a United States National Stage Application under 35 U.S.C. §371 of International Patent Application No. PCT/JP2008/068258, filed Oct. 1, 2008, which is incorporated by reference into this application as if fully set forth herein.

TECHNICAL FIELD

The present invention relates to decoding and encoding audio signals, and more particularly, to downmixing audio signals.

BACKGROUND ART

In recent years, AC3 (Audio Code number 3), ATRAC (Adaptive TRansform Acoustic Coding), AAC (Advanced Audio Coding), and so forth, which realize high sound quality, have been used as schemes for encoding audio signals. Moreover, audio signals of multiple channels such as 7.1 channels or 5.1 channels have been used to reconstruct a real acoustic effect.

When the audio signals of the multiple channels such as 7.1 channels or 5.1 channels are reproduced with a stereo audio apparatus, the process for downmixing the multi-channel audio signals to stereo audio signals is performed.

For example, when encoded 5.1-channel audio signals are downmixed to reproduce the downmixed audio signals with the stereo audio apparatus, first, a decoding process is performed to generate decoded 5-channel audio signals of a left channel, a right channel, a center channel, a left surround channel, and a right surround channel. Subsequently, in order to generate a stereo left-channel audio signal, respective audio signals of the left channel, the center channel, and the left surround channel are multiplied by mixture ratio coefficients and a summation of the multiplication results is performed. In order to generate a stereo right-channel audio signal, respective audio signals of the right channel, the center channel, and the right surround channel are subjected to the multiplication and the summation, similarly.

Patent Citation 1:

Japanese Unexamined Patent Application, First Publication No. 2000-276196

DISCLOSURE OF INVENTION

By the way, there is a need for processing audio signals at a high speed. Although the process for decoding and then downmixing encoded audio signals is often performed by software using a CPU, when the CPU performs another process at the same time, the processing speed may be easily lowered, thereby requiring much time.

Accordingly, an object of the present invention is to provide a novel and useful decoding apparatus, decoding method, encoding apparatus, encoding method, and editing apparatus. A specific object of the present invention is to provide a decoding apparatus, a decoding method, an encoding apparatus, an encoding method, and an editing apparatus that reduce the number of multiplication processes at the time of downmixing audio signals.

In accordance with an aspect of the present invention, there is provided a decoding apparatus including: a storing means for storing encoded audio signals including multi-channel audio signals; a transforming means for transforming the encoded audio signals to generate transform block-based audio signals in a time domain; a window processing means for multiplying the transform block-based audio signals by a product of a mixture ratio of the audio signals and a first window function, the product being a second window function; a synthesizing means for overlapping the multiplied transform block-based audio signals to synthesize multi-channel audio signals; and a mixing means for mixing the synthesized multi-channel audio signals between channels to generate a downmixed audio signal.

In accordance with the present invention, audio signals, before being mixed, are multiplied by the second window function which is a product of the mixture ratio of the audio signals and the first window function. Accordingly, the mixing means need not perform the multiplication of the mixture ratio at the time of mixing the multi-channel audio signals. Moreover, even when the window function by which the window processing means multiplies the audio signals is changed from the first window function to the second window function, the amount of calculation does not increase. Therefore, it is possible to reduce the number of multiplying processes at the time of downmixing the audio signals.

In accordance with another aspect of the present invention, there is provided a decoding apparatus including: a memory storing encoded audio signals including multi-channel audio signals; and a CPU, wherein the CPU is configured to transform the encoded audio signals to generate transform block-based audio signals in a time domain, multiply the transform block-based audio signals by a product of a mixture ratio of the audio signals and a first window function, the product being a second window function, overlap the multiplied transform block-based audio signals to synthesize multi-channel audio signals, and mix the synthesized multi-channel audio signals between channels to generate a downmixed audio signal.

In accordance with the present invention, the same advantageous effects as the invention as recited in the above-mentioned decoding apparatus are obtained.

In accordance with another aspect of the present invention, there is provided an encoding apparatus including: a storing means for storing multi-channel audio signals; a mixing means for mixing the multi-channel audio signals between channels to generate a downmixed audio signal; a separating means for separating the downmixed audio signal to generate transform block-based audio signals; a window processing means for multiplying the transform block-based audio signals by a product of a mixture ratio of the audio signals and a first window function, the product being a second window function; and a transforming means for transforming the multiplied audio signals to generate encoded audio signals.

In accordance with the present invention, the mixed audio signals are multiplied by the second window function which is a product of the mixture ratio of the audio signals and the first window function. Accordingly, the mixing means need not perform the multiplication of the mixture ratio for at least a part of the channels at the time of mixing the multi-channel audio signals. Moreover, even when the window function by which the window processing means multiplies the audio signals is changed from the first window function to the second window function, the amount of calculation does not increase. Therefore, it is possible to reduce the number of multiplying processes at the time of downmixing the audio signals.

In accordance with another aspect of the present invention, there is provided an encoding apparatus including: a memory storing multi-channel audio signals; and a CPU, wherein the CPU is configured to mix the multi-channel audio signals between channels to generate a downmixed audio signal, separate the downmixed audio signal to generate transform block-based audio signals, multiply the transform block-based audio signals by a product of a mixture ratio of the audio signals and a first window function, the product being a second window function, and transform the multiplied audio signals to generate encoded audio signals.

In accordance with the present invention, the same advantageous effects as the invention as recited in the above-mentioned encoding apparatus are obtained.

In accordance with another aspect of the present invention, there is provided a decoding method including: a step of transforming encoded audio signals including multi-channel audio signals to generate transform block-based audio signals in a time domain; a step of multiplying the transform block-based audio signals by a product of a mixture ratio of the audio signals and a first window function, the product being a second window function; a step of overlapping the multiplied transform block-based audio signals to synthesize multi-channel audio signals; and a step of mixing the synthesized multi-channel audio signals between channels to generate a downmixed audio signal.

In accordance with the present invention, audio signals, before being mixed, are multiplied by the second window function which is a product of the mixture ratio of the audio signals and the first window function. Accordingly, it is not necessary to perform the multiplication of the mixture ratio at the time of mixing the multiplied audio signals between the channels to generate a mixed audio signal. Moreover, even when the window function multiplied to audio signals is changed from the first window function to the second window function, the amount of calculation does not increase. Therefore, it is possible to reduce the number of multiplying processes at the time of downmixing audio signals.

In accordance with another aspect of the present invention, there is provided an encoding method including: a step of mixing multi-channel audio signals between channels to generate a downmixed audio signal; a step of separating the downmixed audio signal to generate transform block-based audio signals; a step of multiplying the transform block-based audio signals by a product of a mixture ratio of the audio signals and a first window function, the product being a second window function; and a step of transforming the multiplied audio signals to generate encoded audio signals.

In accordance with the present invention, the mixed audio signals are multiplied by the second window function which is a product of the mixture ratio of the audio signals and the first window function. Accordingly, it is not necessary to perform the multiplication of the mixture ratio for at least a part of the channels at the time of mixing the multi-channel audio signals. Moreover, even when the window function multiplied to the audio signals is changed from the first window function to the second window function, the amount of calculation does not increase. Therefore, it is possible to reduce the number of multiplying processes at the time of downmixing audio signals.

In accordance with the present invention, it is possible to provide a decoding apparatus, a decoding method, an encoding apparatus, an encoding method, and an editing apparatus that reduce the number of multiplying processes at the time of downmixing audio signals.

BRIEF DESCRIPTION OF THE DRAWINGS

FIG. 6A is a diagram illustrating a scaled window function stored in a window function storing unit.

FIG. 6B is a diagram illustrating a scaled window function stored in the window function storing unit.

FIG. 6C is a diagram illustrating a scaled window function stored in the window function storing unit.

EXPLANATION OF REFERENCE

Figure 1:
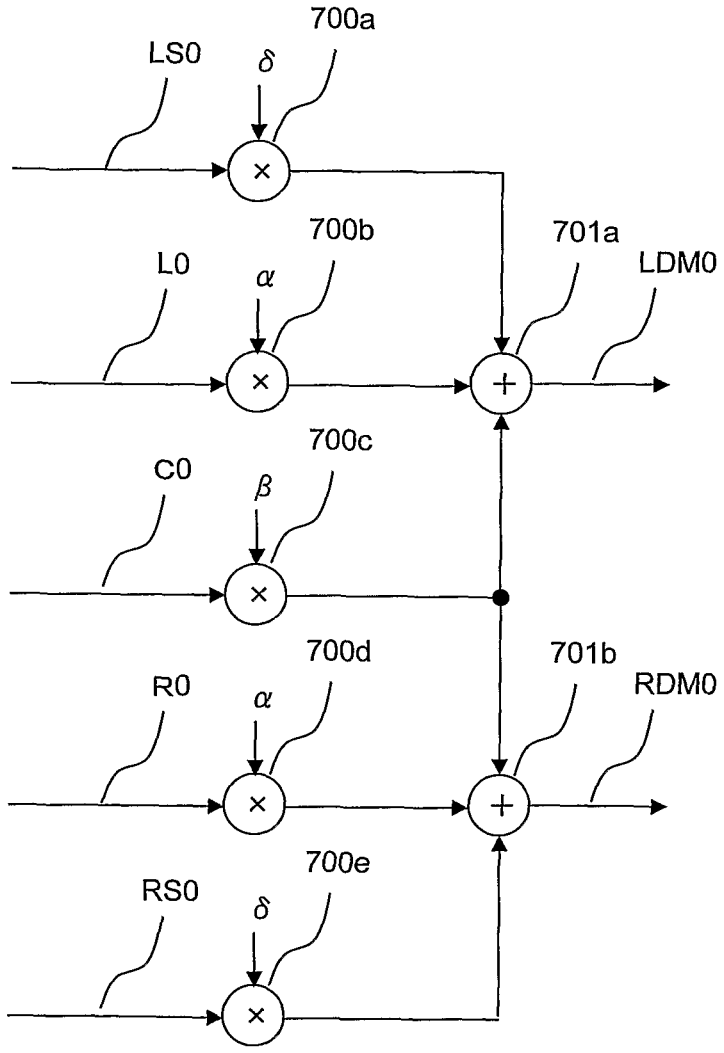
FIG. 1 is a block diagram illustrating a configuration associated with downmixing audio signals.

10 Decoding apparatus
11, 21, 211, 311 Signal storing unit
12 Demultiplexing unit
13*a*, 13*b*, 13*c*, 13*d*, 13*e* Channel decoder
14, 22, 204, 301 Mixing unit
20 Encoding apparatus
23*a*, 23*b* Channel encoder
24 Multiplexing unit
30*a*, 30*b*, 51*a*, 51*b* Adder
40, 63, 201, 304 Transforming unit
41, 61, 202, 303 Window processing unit
42, 62, 212, 312 Window function storing unit
43, 203 Transform block synthesizing unit
50*a*, 50*b*, 50*c*, 50*d*, 50*e* Multiplier
60, 302 Transform block separating unit
73 Editing unit
102, 200, 300 CPU
210, 310 Memory

BEST MODE FOR CARRYING OUT THE INVENTION

Hereinafter, embodiments in accordance with the present invention will be described with reference to the drawings.

[First Embodiment]

A decoding apparatus in accordance with a first embodiment of the present invention is an example with respect to a decoding apparatus and a decoding method which decode encoded audio signals including multi-channel audio signals into downmixed audio signals. Although the AAC is exemplified in the first embodiment, it is needless to say that the present invention is not limited to the AAC.

<Downmixing>

FIG. 1 is a block diagram illustrating a configuration associated with downmixing 5.1-channel audio signals.

Referring to FIG. 1, downmixing is performed by multipliers 700*a* to 700*e* and adders 701*a* and 701*b*.

The multiplier 700*a* multiplies an audio signal LS0 of a left surround channel by a downmix coefficient δ. The multiplier 700*b* multiplies an audio signal L0 of a left channel by a downmix coefficient α. The multiplier 700*c* multiplies an audio signal C0 of a center channel by a downmix coefficient β. The downmix coefficients α, β, and δ are mixture ratios of the audio signals of the respective channels.

The adder 701*a* adds an audio signal output from the multiplier 700*a*, an audio signal output from the multiplier 700*b*, and an audio signal output from the multiplier 700*c* to generate a downmixed left-channel audio signal LDM0. Similarly for the right channel, a downmixed right-channel audio signal RDM0 is generated.

<Decoding Process of Audio Signals>

Figure 2:
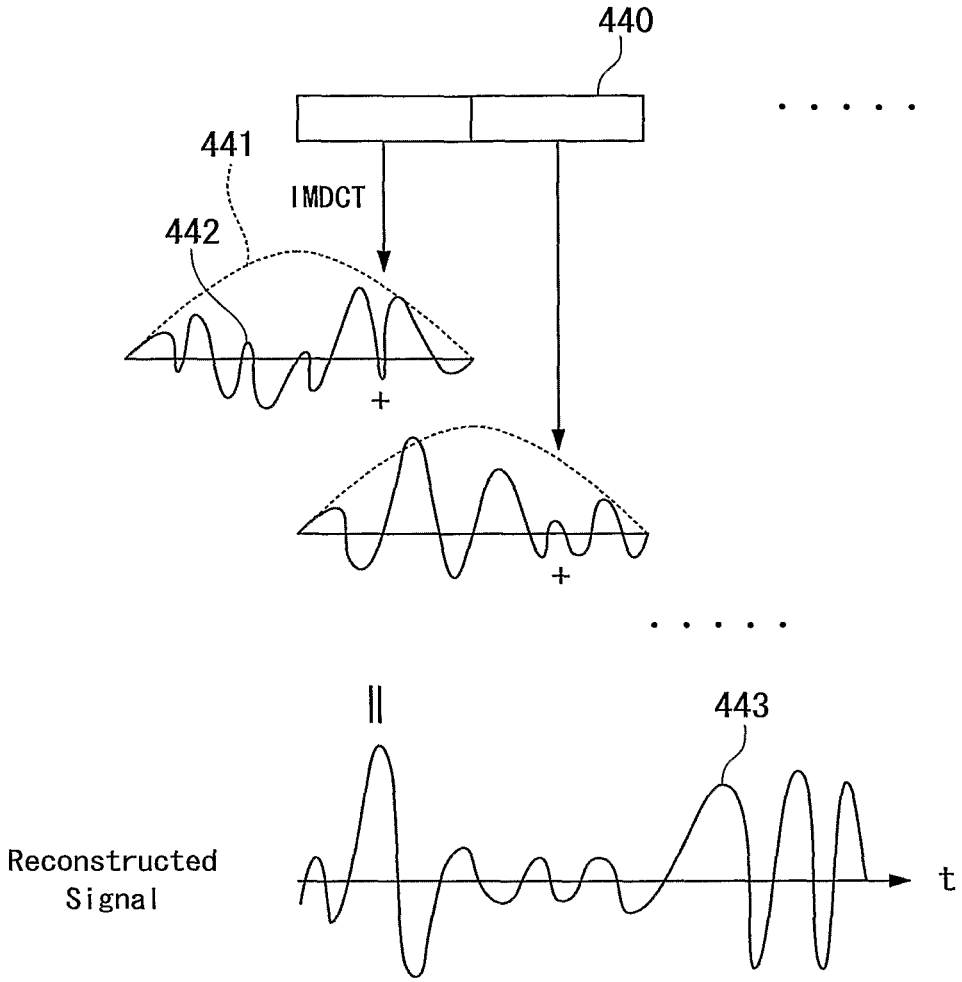
FIG. 2 is a diagram explaining a flow of a decoding process of audio signals.

FIG. 2 is a diagram explaining a flow of a decoding process of audio signals.

Referring to FIG. 2, in the decoding process, MDCT (Modified Discrete Cosine Transform) coefficients 440 are reproduced by entropy-decoding and inversely quantizing a stream including encoded audio signals (encoded signals). The MDCT coefficients 440 are formed of transform (MDCT) block-based data, the transform block having a predetermined length. The reproduced MDCT coefficients 440 are transformed into transform block-based audio signals in a time domain by IMDCT (Inverse MDCT). By overlapping and adding signals 442 obtained by multiplying the transform block-based audio signals by window functions 441, an audio signal 443 which has been subjected to the decoding process is generated.

<Hardware Configuration of Decoding Apparatus>

Figure 3:
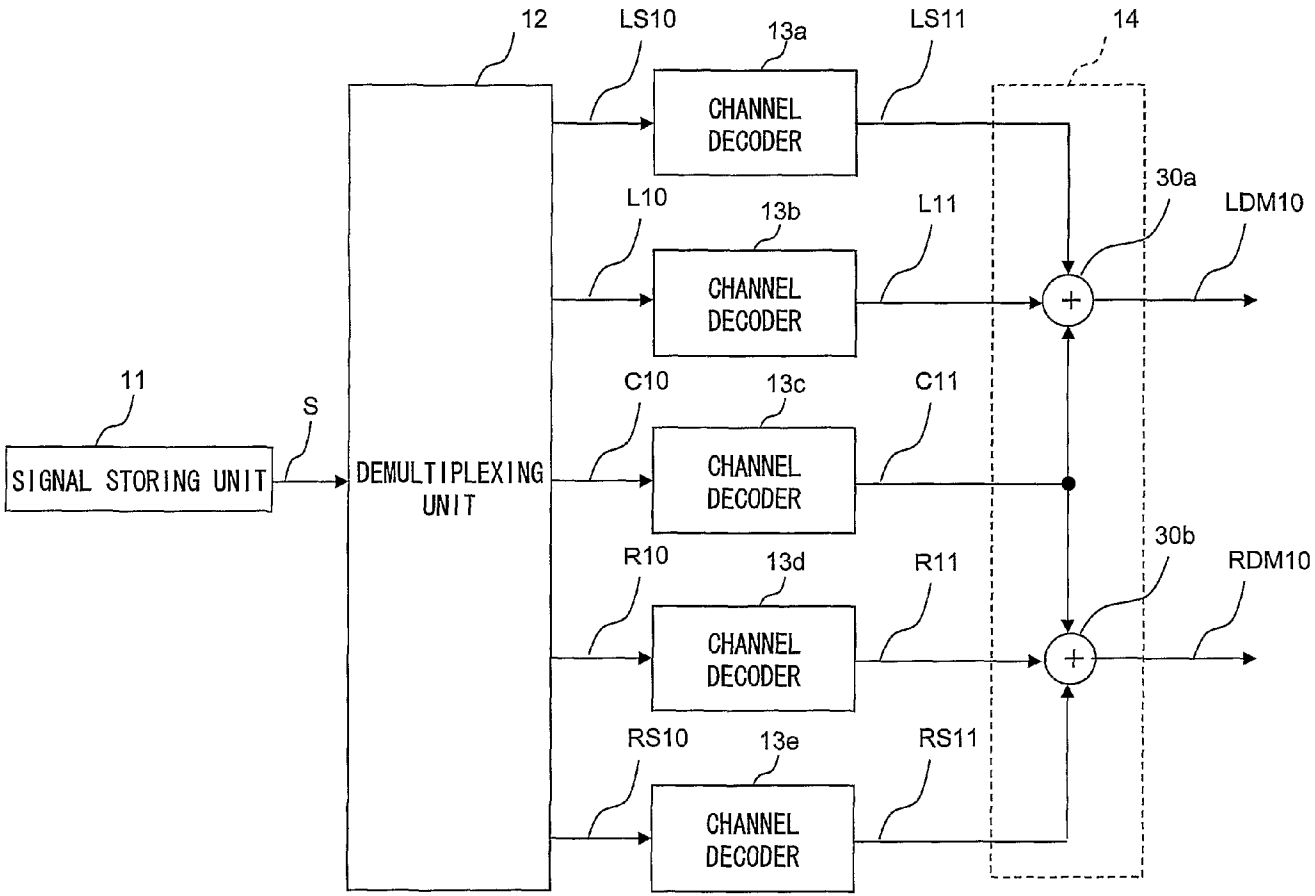
FIG. 3 is a block diagram illustrating a configuration of a decoding apparatus in accordance with a first embodiment of the present invention.

FIG. 3 is a block diagram illustrating a configuration of a decoding apparatus in accordance with the first embodiment of the present invention.

Referring to FIG. 3, a decoding apparatus 10 includes: a signal storing unit 11 which stores a stream including encoded 5.1-channel audio signals (encoded signals); a demultiplexing unit 12 which extracts the encoded 5.1-channel audio signals from the stream; channel decoders 13*a*, 13*b*, 13*c*, 13*d*, and 13*e* which perform decoding processes of the audio signals of the respective channels; and a mixing unit 14 which mixes 5-channel audio signals which have been subjected to the decoding processes to generate 2-channel audio signals, that is, downmixed stereo audio signals. The decoding process in accordance with the first embodiment is an entropy-decoding process based on the AAC. It is to be noted that for the purpose of convenient explanation, recitation of a low-frequency effects (LFE) channel is omitted in the respective embodiments of the present description.

A stream S output from the signal storing unit 11 includes encoded 5.1-channel audio signals.

Figure 4:
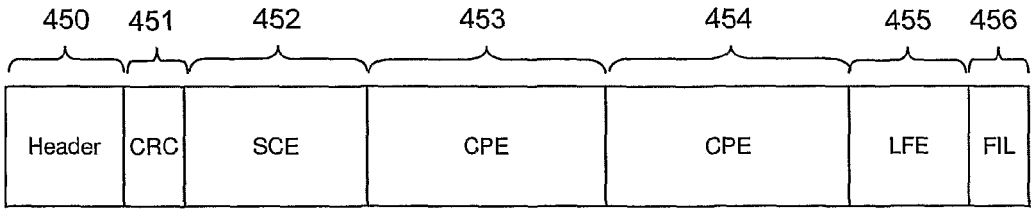
FIG. 4 is a diagram illustrating a structure of a stream.

FIG. 4 is a diagram illustrating a structure of a stream.

Referring to FIG. 4, the structure of the stream shown therein is a structure of one frame (corresponding to 1024 samples) having a stream format called an ADTS (Audio Data Transport Stream). The stream starts from a header 450 and a CRC 451 and includes encoded data of the AAC subsequent thereto.

The header 450 includes a synchronization word, a profile, a sampling frequency, a channel configuration, copyright information, the decoder buffer fullness, the length of one frame (the number of bytes), and so forth. The CRC 451 is a checksum for detecting errors in the header 450 and the encoded data. An SCE (Single Channel Element) 452 is an encoded center-channel audio signal and includes entropy-encoded MDCT coefficients in addition to information on a used window function and quantization, etc.

CPEs (Channel Pair Elements) 453 and 454 are encoded stereo audio signals and include encoding information of the respective channels in addition to joint stereo information. The joint stereo information is information indicating whether an M/S (Mid/Side) stereo should be used and on which bands the M/S stereo should be used if the M/S stereo is used. The encoding information is information including the used window function, information on quantization, encoded MDCT coefficients, etc.

When the joint stereo is used, it is necessary to use the same window function for the stereos. In this case, information on the used window function is merged into one in the CPEs 453 and 454. The CPE 453 corresponds to the left channel and the right channel, and the CPE 454 corresponds to the left surround channel and the right surround channel. An LFE (LFE Channel Element) 455 is an encoded audio signal of the LFE channel and includes substantially the same information as the SCE 452. However, the usable window functions or the usable range of MDCT coefficients are limited. An FIL (Fill Element) 456 is a padding that is inserted as needed to prevent the overflow of the decoder buffer.

The demultiplexing unit 12 extracts encoded audio signals of the respective channels (encoded signals LS10, L10, C10, R10, and RS10) from the stream having the above-mentioned structure and outputs audio signals of the respective channels to the channel decoders 13*a*, 13*b*, 13*c*, 13*d*, and 13*e* corresponding to the respective channels.

The channel decoder 13*a* performs a decoding process of the encoded signal LS10 obtained by encoding the audio signal of the left surround channel. The channel decoder 13*b* performs a decoding process of the encoded signal L10 obtained by encoding the audio signal of the left channel. The channel decoder 13*c* performs a decoding process of the encoded signal C10 obtained by encoding the audio signal of the center channel. The channel decoder 13*d* performs a decoding process of the encoded signal R10 obtained by encoding the audio signal of the right channel. The channel decoder 13*e* performs a decoding process of the encoded signal RS10 obtained by encoding the audio signal of the right surround channel.

The mixing unit 14 includes adders 30*a* and 30*b*. The adder 30*a* adds an audio signal LS11 processed by the channel decoder 13*a*, an audio signal L11 processed by the channel decoder 13*b*, and an audio signal C11 processed by the channel decoder 13*c* to generate a downmixed left-channel audio signal LDM10. The adder 30*b* adds the audio signal C11 processed by the channel decoder 13*c*, an audio signal R11 processed by the channel decoder 13*d*, and an audio signal RS11 processed by the channel decoder 13*e* to generate a downmixed right-channel audio signal RDM10.

Figure 5:
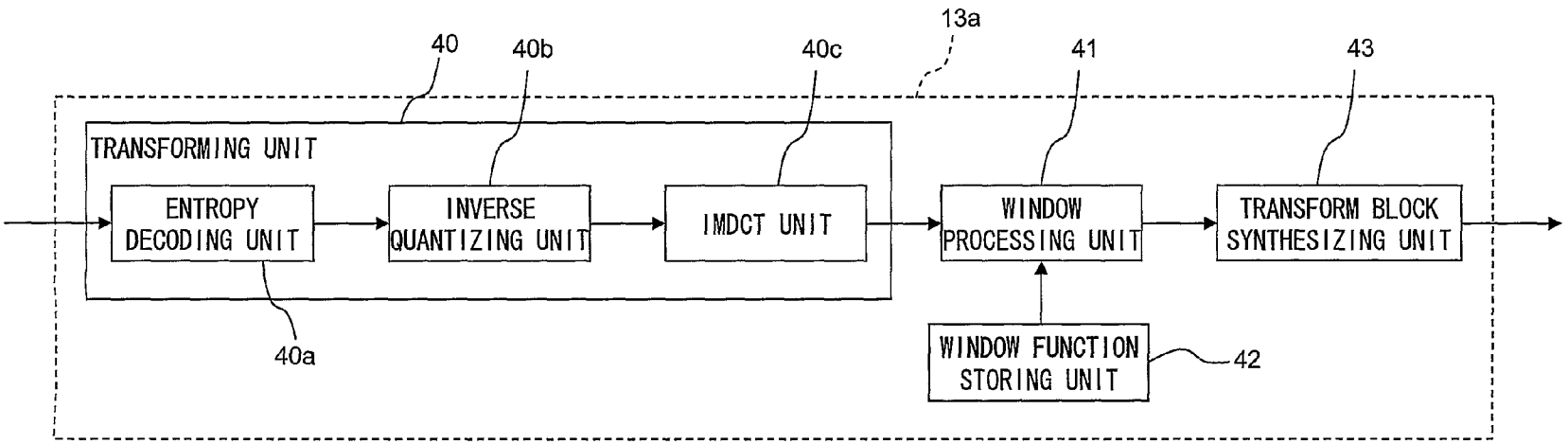
FIG. 5 is a block diagram illustrating a configuration of a channel decoder.

FIG. 5 is a block diagram illustrating a configuration of a channel decoder. It is to be noted that since the respective configurations of the channel decoders 13*a*, 13*b*, 13*c*, 13*d*, and 13*e* shown in FIG. 3 are basically equal to each other, the configuration of the channel decoder 13*a* is shown in FIG. 5.

Referring to FIG. 5, the channel decoder 13*a* includes a transforming unit 40, a window processing unit 41, a window function storing unit 42, and a transform block synthesizing unit 43. The transforming unit 40 includes an entropy decoding unit 40*a*, an inverse quantizing unit 40*b*, and an IMDCT unit 40*c*. The processes performed by the respective units are controlled by control signals output from the demultiplexing unit 12.

The entropy decoding unit 40*a* decodes the encoded audio signals (bitstreams) by entropy decoding to generate quantized MDCT coefficients. The inverse quantizing unit 40*b* inversely quantizes the quantized MDCT coefficients output from the entropy decoding unit 40*a* to generate inversely-quantized MDCT coefficients. The IMDCT unit 40*c* transforms the MDCT coefficients output from the inverse quantizing unit 40*b* into audio signals in a time domain by IMDCT. Equation (1) indicates a transformation of IMDCT.

$$x_{i,n} = \frac{2}{N}\sum_{k=0}^{\frac{N}{2}-1} spec[i][k]\cos\left(\frac{2\pi}{N}(n+n_0)\left(k+\frac{1}{2}\right)\right) \text{ for } 0 \le n < N \tag{1}$$

In Equation (1), N represents a window length (the number of samples). spec[i][k] represents MDCT coefficients. i represents an index of transform blocks. k represents an index of the MDCT coefficients. $x_{i,n}$ represents an audio signal in the time domain. n represents an index of the audio signals in the time domain. $n_0$ represents (N/2+1)/2.

The window processing unit 41 multiplies the audio signals in the time domain output from the transforming unit 40 by scaled window functions. The scaled window functions are products of downmix coefficients, which are mixture ratios of the audio signals, and a normalized window function. The window function storing unit 42 stores the window functions by which the window processing unit 41 multiplies the audio signals, and outputs the window functions to the window processing unit 41.

FIGS. 6A to 6C are diagrams illustrating the scaled window functions stored in the window function storing unit 42. FIG. 6A shows a scaled window function to be multiplied to the audio signals of the left channel and the right channel. FIG. 6B shows a scaled window function to be multiplied to the audio signal of the center channel. FIG. 6C shows a scaled window function to be multiplied to the audio signals of the left surround channel and the right surround channel.

Referring to FIG. 6A, N discrete values $\alpha W_0$, $\alpha W_1$, $\alpha W_2$, . . . , and $\alpha W_{N-1}$ are prepared in the window function storing unit 42 (FIG. 5) as the scaled window function to be multiplied to the audio signals of the left channel and the right channel. $W_m$ (where m=0, 1, 2, . . . , N−1) is a value of a normalized window function which does not include a downmix coefficient. $\alpha W_m$ (where m=0, 1, 2, . . . , N−1) is a value of a window function to be multiplied to an audio signal $x_{i,m}$ and is obtained by multiplying the window function value $W_m$ corresponding to an index m by the downmix coefficient α. That is, $\alpha W_0$, $\alpha W_1$, $\alpha W_2$, . . . , and $\alpha W_{N-1}$ are values obtained by scaling the window function values $W_0$, $W_1$, $W_2$, . . . , and $W_{N-1}$ to α times.

The window function storing unit 42 does not necessarily store all the N values, but the window function storing unit 42 may store only N/2 values taking advantage of symmetric property of the window functions. Moreover, the window functions are not necessarily required for all the channels, but the scaled window functions may be shared by the channels having the same scaling factor.

The window processing unit 41 multiplies each of the N pieces of data forming the audio signals output from the transforming unit 40 by the window function values shown in FIG. 6A. That is, the window processing unit 41 multiplies data $x_{i,0}$ expressed by Equation (1) by the window function value $\alpha W_0$ and multiplies data $x_{i,1}$ by the window function value $\alpha W_1$. The same is true of other window function values. It is to be noted that in the AAC, a plurality of kinds of window functions having different window lengths are combined for use, and hence the value of N varies depending on the kinds of the window functions.

Moreover, as shown in FIG. 6B, N discrete values $\beta W_0$, $\beta W_1$, $\beta W_2$, . . . , and $\beta W_{N-1}$ are prepared in the window function storing unit 42 (FIG. 5) as the scaled window function to be multiplied to the audio signals of the center channel.

Furthermore, as shown in FIG. 6C, N discrete values $\delta W_0$, $\delta W_1$, $\delta W_2$, . . . , and $\delta W_{N-1}$ are prepared in the window function storing unit 42 (FIG. 5) as the scaled window function to be multiplied to the audio signals of the left surround channel and the right surround channel.

The definition of the respective values shown in FIG. 6B and FIG. 6C is the same as that of the respective values shown in FIG. 6A. Moreover, the processing details of the window processing unit 41 on the respective values shown in FIGS. 6B and 6C are the same as the processing details of the window processing unit 41 on the respective values shown in FIG. 6A.

Equation (2) shown below is an exemplary equation of the downmix coefficient α. Equation (3) shown below is an exemplary equation of the downmix coefficients β and δ.

$$\alpha = \frac{1}{1+2/\sqrt{2}} \tag{2}$$

$$\beta = \delta = \frac{1/\sqrt{2}}{1+2/\sqrt{2}} \tag{3}$$

A variety of functions can be used as the window function for calculating the values $W_0$, $W_1$, $W_2$, . . . , and $W_{N-1}$ shown in FIG. 6A to FIG. 6C. For example, a sine window can be used. Equations (4) and (5) shown below are sine window functions.

$$W_{SIN_LEFT}(n) = \sin\left(\frac{\pi}{N}\left(n+\frac{1}{2}\right)\right) \text{ for } 0 \le n < \frac{N}{2} \tag{4}$$

$$W_{SIN_RIGHT}(n) = \sin\left(\frac{\pi}{N}\left(n+\frac{1}{2}\right)\right) \text{ for } \frac{N}{2} \le n < N \tag{5}$$

A KBD window (Kaiser-Bessel Derived window) can be used instead of the above-described sine window.

The transform block synthesizing unit 43 overlaps the transform block-based audio signals output from the window processing unit 41 to synthesize audio signals which have been subjected to the decoding process. Equation (6) shown below represents the overlapping of the transform block-based audio signals.

$$out_{i,n} = z_{i,n} + z_{i-1,n+\frac{N}{2}} \quad \text{for } 0 \le n < \frac{N}{2} \tag{6}$$

In Equation (6), i represents an index of transform blocks. n represents an index of audio signals in the transform blocks. $out_{i,n}$ represents an overlapped audio signal. z represents a transform block-based audio signal multiplied by the window function, and $z_{i,n}$ is represented by Equation (7) shown below using the scaled window function w(n) and the audio signal $x_{i,n}$ in the time domain.

$$z_{i,n}=w(n)x_{i,n} \tag{7}$$

According to Equation (6), the audio signal $out_{i,n}$ is generated by adding the first-half audio signal in the transform block i and the second-half audio signal in the transform block i−1 immediately prior to the transform block i. When a long window is used, $out_{i,n}$ expressed by Equation (6) corresponds to one frame. Moreover, when a short window is used, the audio signal obtained by overlapping eight transform blocks corresponds to one frame.

The audio signals of the respective channels generated by the channel decoders 13*a*, 13*b*, 13*c*, 13*d*, and 13*e* as described above are mixed and downmixed by the mixing unit 14. Since the multiplication of the downmix coefficients is performed by the processes in the channel decoders 13*a*, 13*b*, 13*c*, 13*d*, and 13*e*, the mixing unit 14 does not multiply the downmix coefficients. In this way, the downmixing of the audio signals is completed.

In accordance with the decoding apparatus of the first embodiment, the window functions multiplied by the downmix coefficients are multiplied to the audio signals which have not yet processed by the mixing unit 14. Accordingly, the mixing unit 14 need not multiply the downmix coefficients. Since the multiplication of the downmix coefficients is not performed, it is possible to reduce the number of multiplication processes at the time of downmixing the audio signals, thereby processing the audio signals at a high speed. Moreover, since the multipliers required for the multiplications of the downmix coefficients in the conventional downmixing can be omitted, it is possible to reduce the circuit size and the power consumption.

<Functional Configuration of Decoding Apparatus>

The functions of the above-described decoding apparatus 10 may be embodied as software processes using a program.

Figure 7:
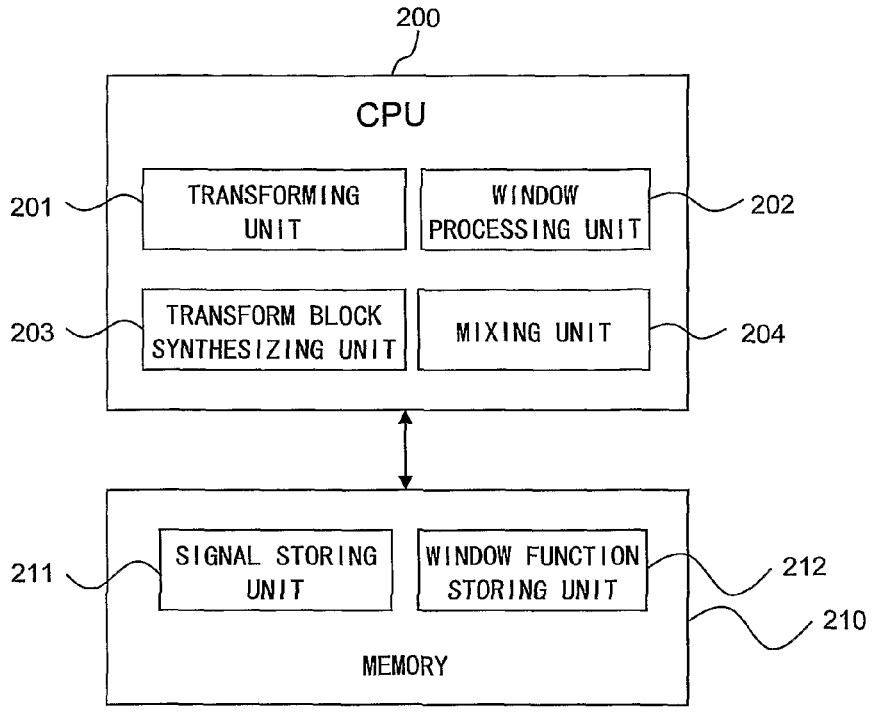
FIG. 7 is a functional configuration diagram of the decoding apparatus in accordance with the first embodiment.

FIG. 7 is a functional configuration diagram of the decoding apparatus in accordance with the first embodiment.

Referring to FIG. 7, a CPU 200 constructs respective functional blocks of a transforming unit 201, a window processing unit 202, a transform block synthesizing unit 203, and a mixing unit 204 by means of an application program deployed in a memory 210. The function of the transforming unit 201 is the same as the function of the transforming unit 40 shown in FIG. 5. The function of the window processing unit 202 is the same as the function of the window processing unit 41 shown in FIG. 5. The function of the transform block synthesizing unit 203 is the same as the function of the transform block synthesizing unit 43 shown in FIG. 5. The function of the mixing unit 204 is the same as the function of the mixing unit 14 shown in FIG. 3.

The memory 210 constructs functional blocks of a signal storing unit 211 and a window function storing unit 212. The function of the signal storing unit 211 is the same as the function of the signal storing unit 11 shown in FIG. 3. The function of the window function storing unit 212 is the same as the function of the window function storing unit 42 shown in FIG. 5. The memory 210 may be any one of a read only memory (ROM) and a random access memory (RAM), or may include both of them. In the present description, an explanation will be given assuming that the memory 210 includes both the ROM and the RAM. The memory 210 may include an apparatus having a recording medium such as a hard disk drive (HDD), a semiconductor memory, a magnetic tape drive, or an optical disk drive. The application program executed by the CPU 200 may be stored in the ROM or the RAM, or may be stored in the HDD and so forth having the above-described recording medium.

The decoding function of the audio signals is embodied by the above-mentioned respective functional blocks. The audio signals (including encoded signals) to be processed by the CPU 200 are stored in the signal storing unit 211. The CPU 200 performs the process for reading out the encoded signals to be subjected to the decoding process from the signal storing unit 211, and transforming the encoded audio signals by the use of the transforming unit 201 to generate transform block-based audio signals in the time domain, the transform block having a predetermined length.

Moreover, the CPU 200 performs the process for multiplying the audio signals in the time domain by the window functions by the use of the window processing unit 202. In this process, the CPU 200 reads out the window functions to be multiplied to the audio signals from the window function storing unit 212.

Moreover, the CPU 200 performs the process for overlapping the transform block-based audio signals to synthesize audio signals which have been subjected to the decoding process by the use of the transform block synthesizing unit 203.

Moreover, the CPU 200 performs the process for mixing the audio signals by the use of the mixing unit 204. Downmixed audio signals are stored in the signal storing unit 211.

<Decoding Method>

Figure 8:
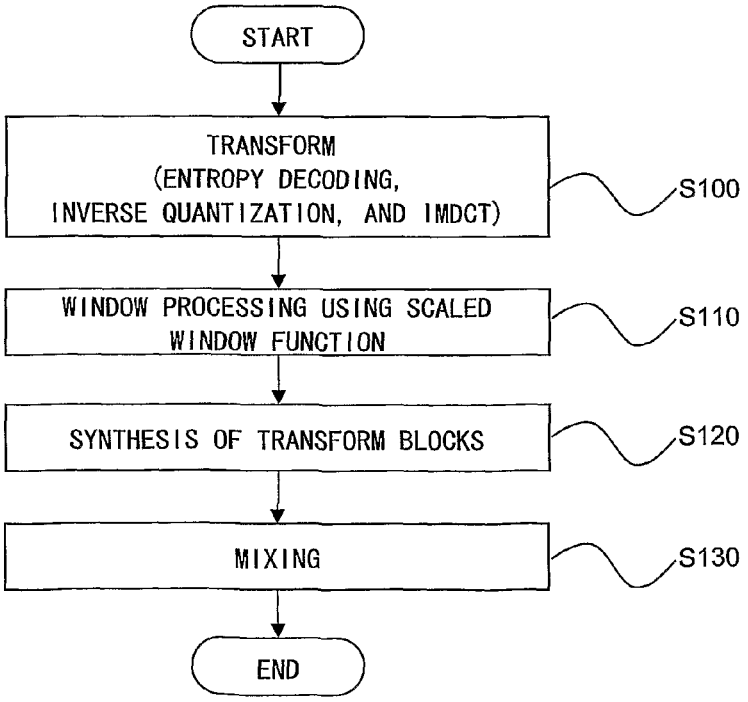
FIG. 8 is a flowchart illustrating a decoding method in accordance with the first embodiment of the present invention.

FIG. 8 is a flowchart illustrating a decoding method in accordance with the first embodiment of the present invention. Here, the decoding method in accordance with the first embodiment of the present invention will be described with reference to FIG. 8 using an example in which 5.1-channel audio signals are decoded and downmixed.

First, in step S100, the CPU 200 transforms the encoded signals, obtained by encoding the audio signals of respective channels including the left surround channel (LS), the left channel (L), the center channel (C), the right channel (R), and the right surround channel (RS), into transform block-based audio signals in the time domain, the transform block having a predetermined length. In this transformation, respective processes including the entropy decoding, the inverse quantization, and the IMDCT are performed.

Subsequently, in step S110, the CPU 200 reads out the scaled window functions from the window function storing unit 211 and multiplies the transform block-based audio signals in the time domain by these window functions. As described above, the scaled window functions are products of the downmix coefficients, which are the mixture ratios of the audio signals, and the normalized window function. Moreover, as an example, scaled window functions are prepared for the respective channels, and the window functions corresponding to the respective channels are multiplied to the audio signals of the respective channels.

Subsequently, in step S120, the CPU 200 overlaps the transform block-based audio signals processed in step S110 and synthesizes audio signals which have been subjected to the decoding process. It is to be noted that the audio signals which have been subjected to the decoding process have been multiplied by the downmix coefficients in step S110.

Subsequently, in step S130, the CPU 200 mixes the 5-channel audio signals which have been subjected to the decoding process in step S120 to generate a downmixed left channel (LDM) audio signal and a downmixed right channel (RDM) audio signal.

Specifically, the CPU 200 adds the left surround channel (LS) audio signal synthesized in step S120, the left channel (L) audio signal synthesized in step S120, and the center channel (C) audio signal synthesized in step S120 to generate the downmixed left channel (LDM) audio signal. In addition, the CPU 200 adds the center channel (C) audio signal synthesized in step S120, the right channel (R) audio signal synthesized in step S120, and the right surround channel (RS) audio signal synthesized in step S120 to generate the downmixed right channel (RDM) audio signal. It is important that in this step S130, only the addition processes are performed and the multiplication processes of the downmix coefficients need not be performed unlike the background art.

In accordance with the decoding method of the first embodiment, the window functions multiplied by the downmix coefficients in step S110 are multiplied to the audio signals which have not yet been mixed. Accordingly, in step S130, it is not necessary to perform the multiplication of the downmix coefficients. Since the multiplication of the downmix coefficients is not performed, it is possible to reduce the number of multiplication processes at the time of downmixing the audio signals in step S130, thereby processing the audio signals at a high speed.

Since the window process in accordance with the first embodiment can be applied without depending on the lengths of the MDCT blocks, it is possible to facilitate the process. Although there are two lengths of the window functions (a long window and a short window) in, for example, the AAC, since the window process in accordance with the first embodiment can be applied even if any one of these lengths is used or even if the long window and the short window are arbitrarily combined for use for each channel, it is possible to facilitate the process. Moreover, as will be described in a second embodiment, the same window process as the window process in accordance with the first embodiment can be applied to an encoding apparatus.

It is to be noted that as a modified example of the first embodiment, when the MS stereo is turned on in the left channel and the right channel, that is, when audio signals of the left channel and the right channel are constructed by a sum signal and a difference signal, the MS stereo process may be performed after the inverse quantization process and before the IMDCT process to generate the audio signals of the left channel and the right channel from the sum signal and the difference signal. The MS stereo may be also used for the left surround channel and the right surround channel.

Moreover, as another modified example of the first embodiment, to cope with a case where the decoded signal having the range of [−1.0, 1.0] is scaled to have a predetermined bit precision by multiplying a predetermined gain coefficient and the scaled signal is output from the decoding apparatus, window functions multiplied by the gain coefficient may be multiplied to the signal at the time of decoding. For example, when a 16-bit signal is output from the decoding apparatus, the gain coefficient is set to $2^{15}$. By doing so, since it is not necessary to multiply the signal, after being decoded, by the gain coefficient, the same advantageous effects as described above can be obtained.

Furthermore, as another modified example of the first embodiment, a basis function multiplied by the downmix coefficients may be multiplied to the MDCT coefficients at the time of performing the IMDCT. By doing so, since it is not necessary to perform the multiplication of the downmix coefficients at the time of downmixing, the same advantageous effects as described above can be obtained.

[Second Embodiment]

An encoding apparatus in accordance with a second embodiment of the present invention is an example with respect to an encoding apparatus and an encoding method for generating downmixed encoded audio signals from multichannel audio signals. Although the AAC is exemplified in the second embodiment, it is needless to say that the present invention is not limited to the AAC.

<Encoding Process of Audio Signals>

Figure 9:
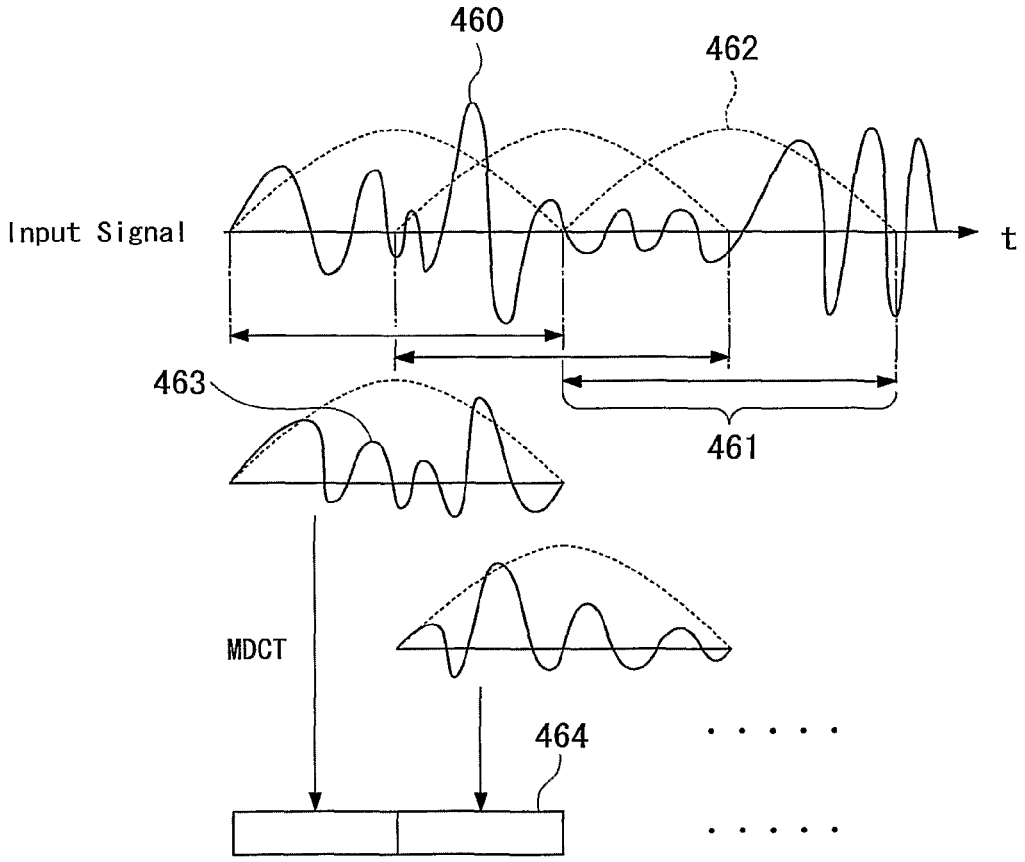
FIG. 9 is a diagram explaining a flow of an encoding process of audio signals.

FIG. 9 is a diagram explaining a flow of an encoding process of audio signals.

Referring to FIG. 9, in the encoding process, transform blocks 461 having a constant interval are cut out (separated) from an audio signal 460 to be processed and are multiplied by window functions 462. At this time, the sampled values of the audio signal 460 are multiplied by the values of the window functions which have been calculated beforehand. The respective transform blocks are set to overlap with other transform blocks.

Audio signals 463 in the time domain multiplied by the window functions 462 are transformed into MDCT coefficients 464 by MDCT. The MDCT coefficients 464 are quantized and entropy-encoded to generate a stream including encoded audio signals (encoded signals).

<Hardware Configuration of Encoding Apparatus>

Figure 10:
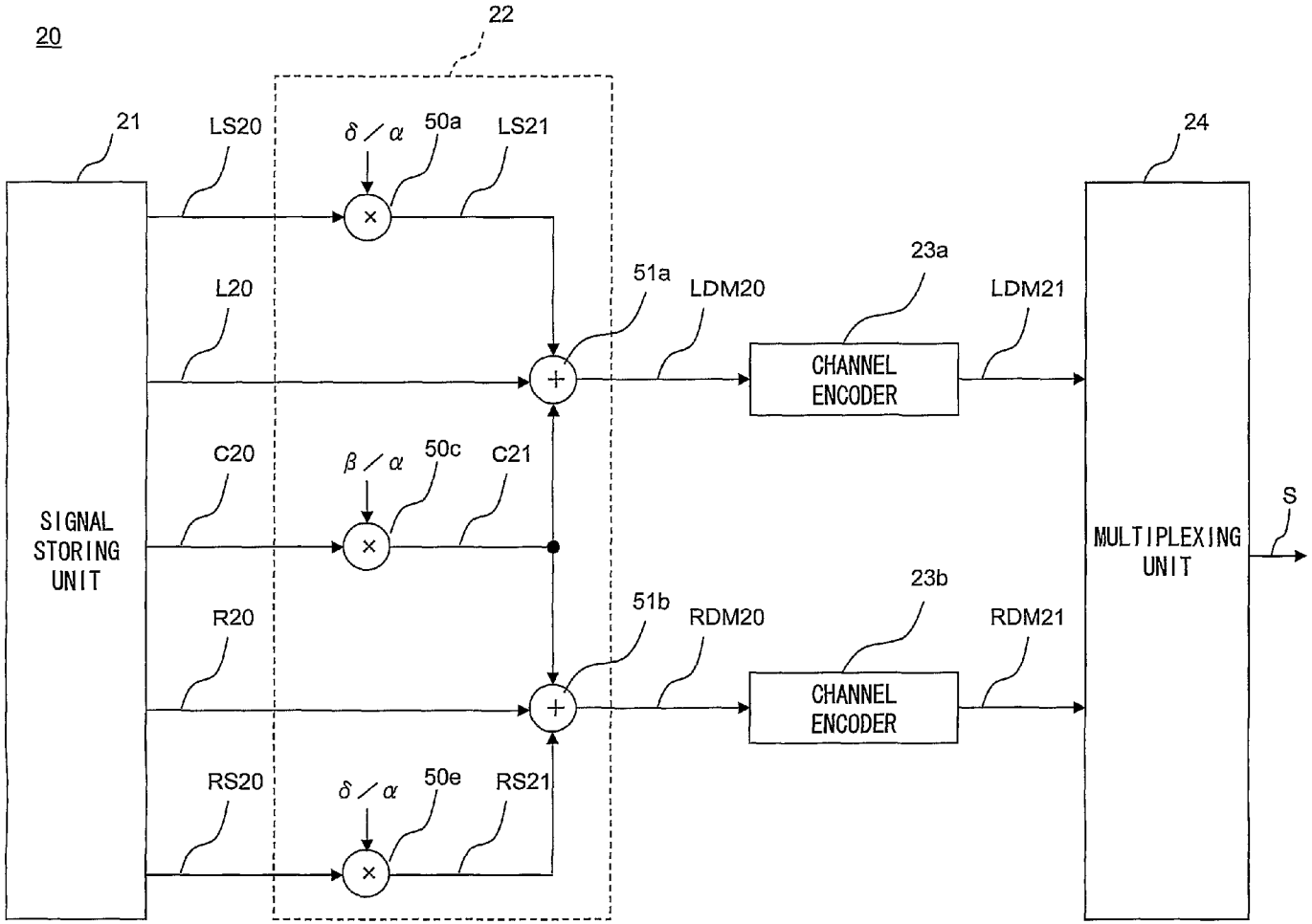
FIG. 10 is a block diagram illustrating a configuration of an encoding apparatus in accordance with a second embodiment of the present invention.

FIG. 10 is a block diagram illustrating a configuration of the encoding apparatus in accordance with the second embodiment of the present invention.

Referring to FIG. 10, an encoding apparatus 20 includes: a signal storing unit 21 which stores 5.1-channel audio signals; a mixing unit 22 which mixes the audio signals of the respective channels to generate two-channel downmixed stereo audio signals; channel encoders 23*a* and 23*b* which perform encoding processes of the audio signals; and a multiplexing unit 24 which multiplexes the two-channel encoded audio signals to generate a stream. The encoding process in accordance with the second embodiment is an entropy encoding process based on the AAC.

The mixing unit 22 includes multipliers 50*a*, 50*c*, and 50*e* and adders 51*a* and 51*b*. The multiplier 50*a* multiplies a left surround channel audio signal LS20 by a predetermined coefficient $\delta/\alpha$. The multiplier 50*c* multiplies a center channel audio signal C20 by a predetermined coefficient $\beta/\alpha$. The multiplier 50*e* multiplies a right surround channel audio signal RS20 by a predetermined coefficient $\delta/\alpha$.

The adder 51*a* adds an audio signal LS21 output from the multiplier 50*a*, a left channel audio signal L20 output from the signal storing unit 21, and an audio signal C21 output from the multiplier 50*c* to generate a downmixed left channel audio signal LDM20. The adder 51*b* adds the audio signal C21 output from the multiplier 50*c*, a right channel audio signal R20 output from the signal storing unit 21, and an audio signal RS21 output from the multiplier 50*e* to generate a downmixed right channel audio signal RDM 20.

The channel encoder 23*a* performs an encoding process of the left channel audio signal LDM20. The channel encoder 23*b* performs an encoding process of the right channel audio signal RDM20.

The multiplexing unit 24 multiplexes an audio signal LDM21 output from the channel encoder 23*a* and an audio signal RDM21 output from the channel encoder 23*b* to generate a stream S.

Figure 11:
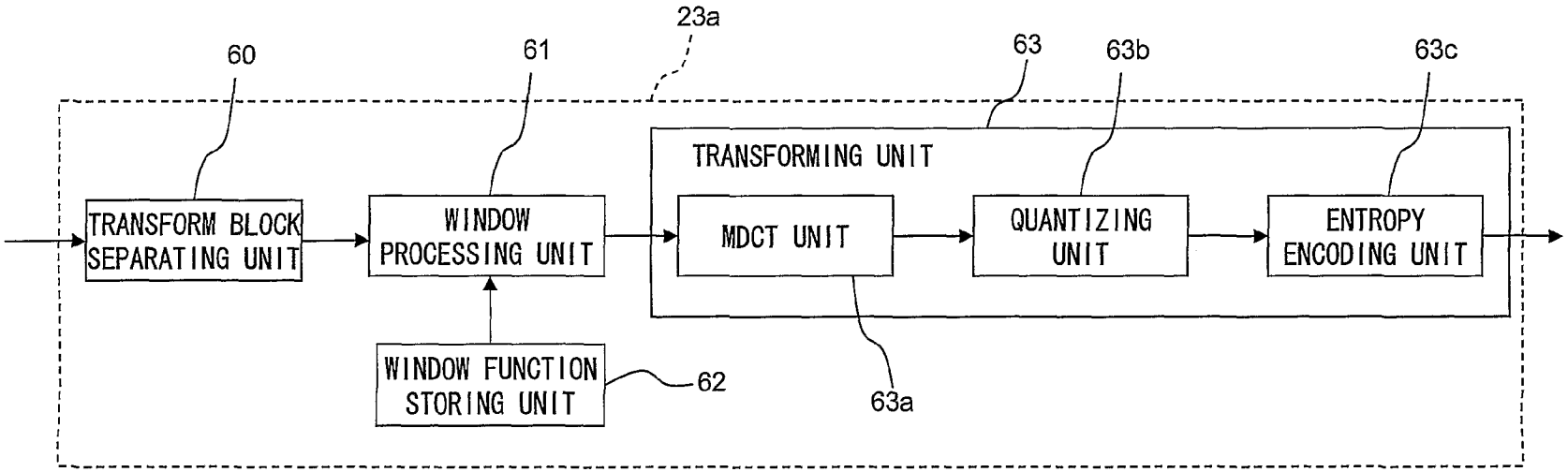
FIG. 11 is a block diagram illustrating a configuration of a channel encoder.

FIG. 11 is a block diagram illustrating a configuration of a channel encoder. Since the configurations of the respective channel encoders 23*a* and 23*b* shown in FIG. 10 are basically similar to each other, the configuration of the channel encoder 23*a* is shown in FIG. 11.

Referring to FIG. 11, the channel encoder 23*a* includes a transform block separating unit 60, a window processing unit 61, a window function storing unit 62, and a transforming unit 63.

The transform block separating unit 60 separates input audio signals into transform block-based audio signals, the transform block having a predetermined length.

The window processing unit 61 multiplies the audio signals output from the transform block separating unit 60 by the scaled window functions. The scaled window functions are product of downmix coefficients, which determine the mixture ratios of the audio signals, and a normalized window function. Similarly to the first embodiment, a variety of functions such as a KBD window or a sine window can be used as the window functions. The window function storing unit 62 stores the window functions by which the window processing unit 61 multiplies the audio signals, and outputs the window functions to the window processing unit 61.

The transforming unit 63 includes an MDCT unit 63*a*, a quantizing unit 63*b*, and an entropy encoding unit 63*c*.

The MDCT unit 63*a* transforms the audio signals in the time domain output from the window processing unit 61 into MDCT coefficients by MDCT. Equation (8) shows a transformation of the MDCT.

$$X_{i,k} = 2 \cdot \sum_{n=0}^{N-1} z_{i,n} \cos\left(\frac{2\pi}{N}(n+n_0)\left(k+\frac{1}{2}\right)\right) \text{ for } 0 \le k < N/2 \tag{8}$$

In Equation (8), N represents a window length (the number of samples). $z_{i,n}$ represents windowed audio signals in the time domain. i represents an index of transform blocks. n represents an index of the audio signals in the time domain. $X_{i,k}$ represents MDCT coefficients. k represents an index of the MDCT coefficients. $n_0$ represents (N/2+1)/2.

The quantizing unit 63*b* quantizes the MDCT coefficients output from the MDCT unit 63*a* to generate quantized MDCT coefficients. The entropy encoding unit 63*c* encodes the quantized MDCT coefficients by entropy-encoding to generate encoded audio signals (bitstreams).

Figure 12:
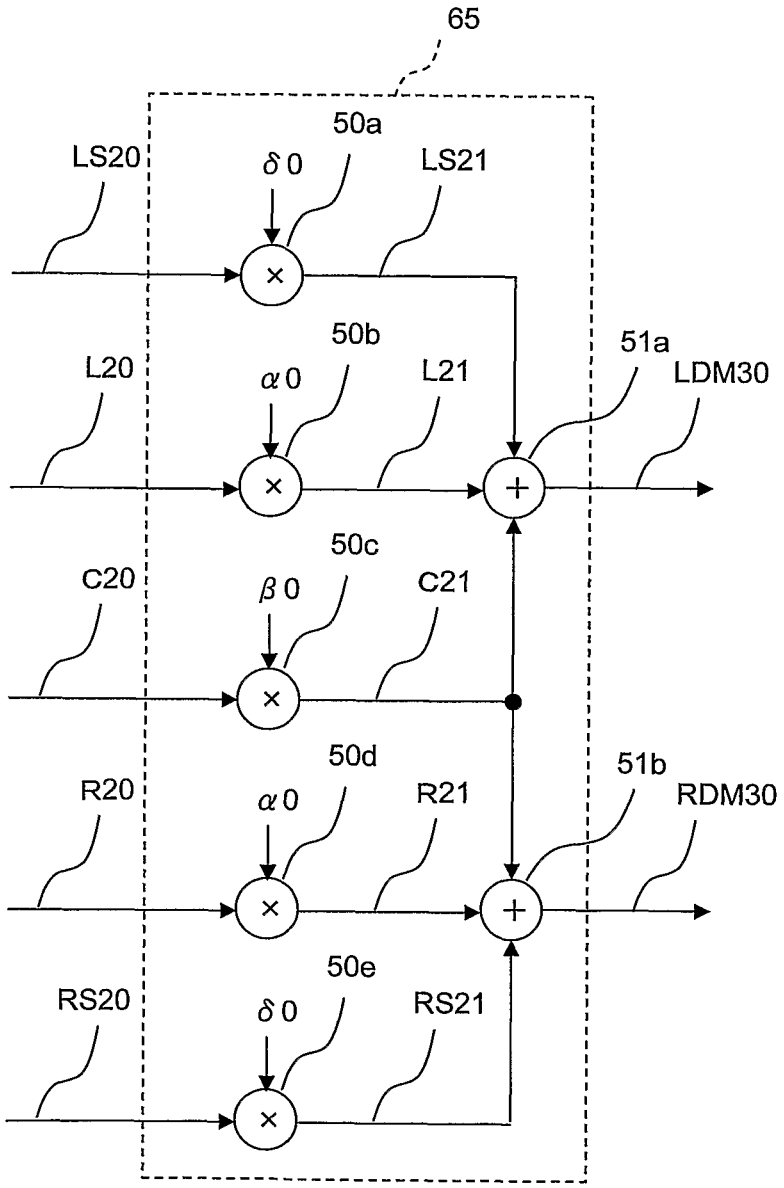
FIG. 12 is a block diagram illustrating a configuration of a mixing unit on which a mixing unit of the encoding apparatus in accordance with the second embodiment is based.

FIG. 12 is a block diagram illustrating a configuration of a mixing unit on which the mixing unit of the encoding apparatus in accordance with the second embodiment of the present invention is based.

Referring to FIG. 12, a mixing unit 65 corresponds to the mixing unit 22 shown in FIG. 10. The mixing unit 65 includes multipliers 50*a*, 50*b*, 50*c*, 50*d*, and 50*e* and adders 51*a* and 51*b*. The multiplier 50*a* multiplies the left surround channel audio signal LS20 by a predetermined coefficient δ0. The multiplier 50*b* multiplies the left channel audio signal L20 by a predetermined coefficient α0. The multiplier 50*c* multiplies the center channel audio signal C20 by a predetermined coefficient β0. The multiplier 50*d* multiplies the right channel audio signal R20 by the predetermined coefficient α0. The multiplier 50*e* multiplies the right surround channel audio signal RS20 by the predetermined coefficient δ0.

The adder 51*a* adds the audio signal LS21 output from the multiplier 50*a*, an audio signal L21 output from the multiplier 50*b*, and the audio signal C21 output from the multiplier 50*c* to generate a downmixed left channel audio signal LDM30. The adder 51*b* adds the audio signal C21 output from the multiplier 50*c*, an audio signal R21 output from the multiplier 50*d*, and the audio signal RS21 output from the multiplier 50*e* to generate a downmixed right channel audio signal RDM30.

The mixing unit 65 performs the same downmixing as shown in FIG. 1 when the downmix coefficients are represented by α, β, and δ, the downmix coefficient α is set to the coefficient α0 shown in FIG. 12, the downmix coefficient β is set to the coefficient β0, and the downmix coefficient δ is set to the coefficient δ0. By setting these coefficients α0, β0, and δ0 to proper values, it is possible to construct the mixing unit 22 in which the number of multiplications is reduced in comparison with that in the mixing unit 65.

Referring to FIG. 10 again together with FIG. 12, in the mixing unit 22, the coefficients to be multiplied to the left channel audio signal L20 and the right channel audio signal R20 are set to 1 (=α/α). The coefficient to be multiplied to the center channel audio signal C20 is set to a value (=β/α) obtained by dividing the downmix coefficient β by the downmix coefficient α. The coefficients to be multiplied to the left surround channel audio signal LS20 and the right surround channel audio signal RS20 are set to a value (=δ/α) obtained by dividing the downmix coefficient δ by the downmix coefficient α.

That is, the coefficients to be multiplied to the audio signals in accordance with the second embodiment are values obtained by multiplying the respective coefficients to be multiplied to the audio signals shown in FIG. 1 by the reciprocal (=1/α) of the downmix coefficient α. Moreover, since the coefficients to be multiplied to the left channel audio signal L20 and the right channel audio signal R20 are set to 1, as shown in FIG. 10, it is not necessary to perform the multiplications on the left channel audio signal L20 and the right channel audio signal R20. Accordingly, the multipliers 50*b* and 50*d* of the mixing unit 65 are omitted from the mixing unit 22.

In order to cancel the multiplication of the reciprocal (=1/α) of the downmix coefficient a to the respective coefficients to be multiplied to the audio signals, it is necessary to multiply the downmixed audio signals by the downmix coefficient α. In the second embodiment, the window functions by which the window processing unit 61 multiplies the audio signals are set to scaled window functions obtained by multiplying the window functions by the downmix coefficient α. Accordingly, the multiplication of the reciprocal (=1/α) of the downmix coefficient a to the respective coefficients to be multiplied to the audio signals is canceled.

Referring to FIG. 10 again, when the downmix coefficients α and β are equal to each other or the downmix coefficients α and δ are equal to each other, β/α or δ/α is 1 and thus the multiplier 50*c* or the multipliers 50*a* and 50*e* can be omitted in addition to the multipliers associated with the left channel and the right channel. When the downmix coefficients α, β, and δ are equal to each other, β/α and δ/α are 1 and thus the multipliers associated with all the channels can be omitted.

Moreover, in the above explanation, the respective coefficients to be multiplied to the audio signals are multiplied by the reciprocal (=1/α) of the downmix coefficient α, but the respective coefficients to be multiplied to the audio signals may be multiplied by the reciprocal (=1/β) of the downmix coefficient β or the reciprocal (=1/δ) of the downmix coefficient δ.

When the respective coefficients to be multiplied to the audio signals are multiplied by the reciprocal (=1/β) of the downmix coefficient β, the scaled window functions by which the window processing unit 61 multiplies the audio signals are products of the downmix coefficient β and the normalized window functions. Moreover, the configuration of the mixing unit 22 is obtained by omitting the multiplier 50*c* from the configuration of the mixing unit 65 shown in FIG. 12.

When the respective coefficients to be multiplied to the audio signals are multiplied by the reciprocal (=1/δ) of the downmix coefficient δ, the scaled window functions by which the window processing unit 61 multiplies the audio signals are products of the downmix coefficient δ and the normalized window functions. Moreover, the configuration of the mixing unit 22 is obtained by omitting the multipliers 50*a* and 50*e* from the configuration of the mixing unit 65 shown in FIG. 12.

In accordance with the encoding apparatus of the second embodiment, the window functions multiplied by the downmix coefficients are multiplied to the audio signals having been processed by the mixing unit 22. Accordingly, the mixing unit 22 need not perform the multiplication of the downmix coefficients on at least a part of the channels. Since the multiplication of the downmix coefficients is not performed on at least the part of the channels, it is possible to reduce the number of multiplication processes at the time of downmixing the audio signals, thereby processing the audio signals at a high speed. Moreover, since the multiplier(s) required for the multiplication of the downmix coefficients in the conventional downmixing can be omitted, it is possible to reduce the circuit size and the power consumption.

For example, even when the downmix coefficients are different depending on the channels, the multiplication of the downmix coefficients in the mixing unit 22 can be omitted for at least one channel. In particular, when the downmix coefficients of a plurality of channels are equal to each other, it is possible to further omit the multiplication of the downmix coefficients in the mixing unit 22.

<Functional Configuration of Encoding Apparatus>

The above-described functions of the encoding apparatus 20 may be embodied by software processes using a program.

Figure 13:
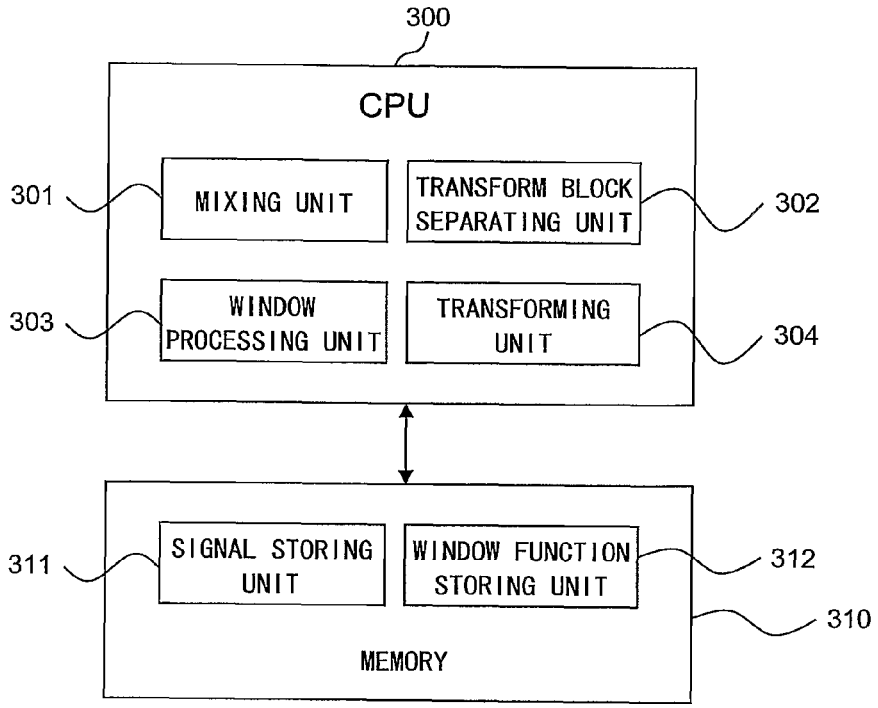
FIG. 13 is a functional configuration diagram of the encoding apparatus in accordance with the second embodiment.

FIG. 13 is a functional configuration diagram of the encoding apparatus in accordance with the second embodiment.

Referring to FIG. 13, a CPU 300 constructs respective functional blocks of a mixing unit 301, a transform block separating unit 302, a window processing unit 303, and a transforming unit 304 by the use of an application program deployed in a memory 310. The function of the mixing unit 301 is the same as the mixing unit 22 shown in FIG. 10. The function of the transform block separating unit 302 is the same as the transform block separating unit 60 shown in FIG. 11. The function of the window processing unit 303 is the same as the window processing unit 61 shown in FIG. 11. The function of the transforming unit 304 is the same as the transforming unit 63 shown in FIG. 11.

The memory 310 constructs functional blocks of a signal storing unit 311 and a window function storing unit 312. The function of the signal storing unit 311 is the same as the function of the signal storing unit 21 shown in FIG. 10. The function of the window function storing unit 312 is the same as the function of the window function storing unit 62 shown in FIG. 11. The memory 310 may be any one of a read only memory (ROM) and a random access memory (RAM), or may include both of them. In the present description, an explanation will be given assuming that the memory 310 includes both the ROM and the RAM. The memory 310 may include an apparatus having a recording medium such as a hard disk drive (HDD), a semiconductor memory, a magnetic tape drive, or an optical disk drive. The application program executed by the CPU 300 may be stored in the ROM or the RAM, or may be stored in the HDD having the above-described recording medium.

The encoding function of the audio signals is embodied by the above-mentioned respective functional blocks. The audio signals (including encoded signals) to be processed by the CPU 300 are stored in the signal storing unit 311. The CPU 300 performs the process for reading out audio signals to be downmixed from the memory 310 and mixing the audio signals by the use of the mixing unit 301.

Moreover, the CPU 300 performs the process for separating the downmixed audio signals by the use of the transform block separating unit 302 to generate transform block-based audio signals in the time domain, the transform block having a predetermined length.

Moreover, the CPU 300 performs the process for multiplying the downmixed audio signals by the window functions by the use of the window processing unit 303. In this process, the CPU 300 reads out the window functions to be multiplied to the audio signals from the window function storing unit 312.

Moreover, the CPU 300 performs the process for transforming the audio signals to generate encoded audio signals by the use of the transforming unit 304. The encoded audio signals are stored in the signal storing unit 311.

<Encoding Method>

Figure 14:
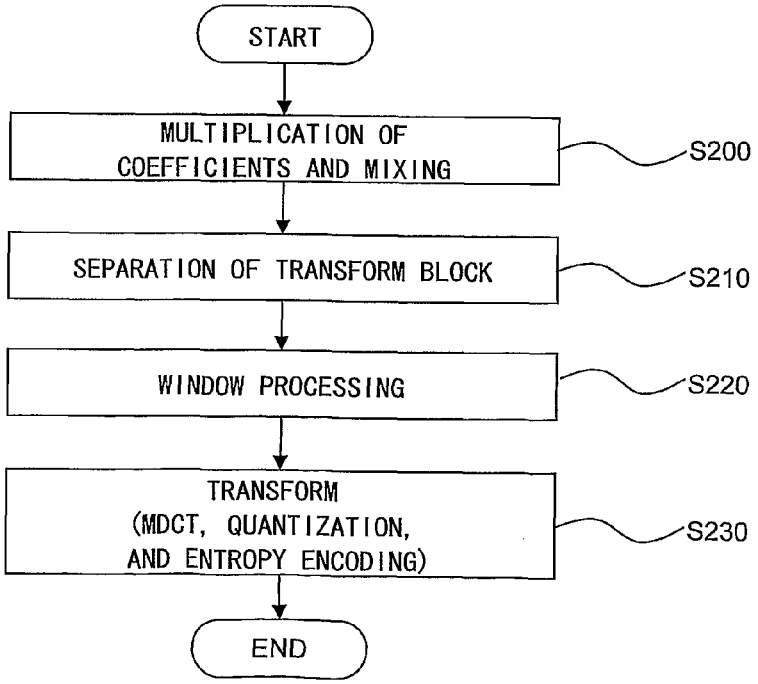
FIG. 14 is a flowchart illustrating an encoding method in accordance with the second embodiment of the present invention.

FIG. 14 is a flowchart illustrating an encoding method in accordance with the second embodiment of the present invention. The encoding method in accordance with the second embodiment of the present invention will be described with reference to FIG. 14 using an example in which 5.1-channel audio signals are downmixed and encoded.

First, in step S200, the CPU 300 multiplies a part of audio signals of respective channels including the left surround channel (LS), the left channel (L), the center channel (C), the right channel (R), and the right surround channel (RS) by coefficient(s), and mixes the resultant signals to generate a downmixed left channel (LDM) audio signal and a downmixed right channel (RDM) audio signal.

Specifically, the CPU 300 multiplies the left surround channel (LS) audio signal by the coefficient δ/α and multiplies the center channel (C) audio signal by the coefficient β/α. The multiplication of the left channel (L) audio signal by a coefficient is not performed. The CPU 300 adds the left surround channel (LS) audio signal multiplied by the coefficient δ/α, the left channel (L) audio signal, and the center channel (C) audio signal multiplied by the coefficient β/α to generate the downmixed left channel (LDM) audio signal.

Moreover, the CPU 300 multiplies the center channel (C) audio signal by the coefficient β/α and multiplies the right surround channel (RS) audio signal by the coefficient δ/α. The multiplication of the right channel (R) audio signal by a coefficient is not performed. The CPU 300 adds the center channel (C) audio signal multiplied by the coefficient β/α, the right channel (R) audio signal, and the right surround channel (RS) audio signal multiplied by the coefficient δ/α to generate the downmixed right channel (RDM) audio signal.

Subsequently, in step S210, the CPU 300 separates the audio signals downmixed in step S200 to generate transform block-based audio signals in the time domain, the transform block having a predetermined length.

Subsequently, in step S220, the CPU 300 reads out the window functions from the window function storing unit 312 in the memory 310 and multiplies the audio signals generated in step S210 by the window functions. The window functions are scaled window functions resulting from the multiplication of the downmix coefficients. Moreover, as an example, the window functions are prepared for the respective channels, and the window functions corresponding to the respective channels are multiplied to the audio signals of the respective channels.

Subsequently, in step S230, the CPU 300 transforms the audio signals processed in step S220 to generate encoded audio signals. In this transformation, respective processes including the MDCT, quantization, and entropy encoding are performed.

In accordance with the encoding method of the second embodiment, the window functions multiplied by the downmix coefficients are multiplied to the mixed audio signals. Accordingly, in step S200, it is not necessary to perform the multiplication of the downmix coefficient(s) on at least a part of the channels. Since the multiplication of the downmix coefficient(s) is not performed on at least the part of the channels, it is possible to process the audio signals at a higher speed in step S200, compared with the background art in which the multiplication of the downmix coefficient is performed on all the channels.

It is to be noted that as a modified example of the second embodiment, to cope with a case where the signal having a predetermined bit precision input to the encoding apparatus is scaled to have the range of [−1.0, 1.0] by multiplying a predetermined gain coefficient and the scaled signal is encoded, at the time of encoding, the signal may be multiplied by the window functions which have been multiplied by the gain coefficient. For example, when a 16-bit signal is input to the encoding apparatus, the gain coefficient is set to $1/2^{15}$. By doing so, since it is not necessary to multiply the signal, before being encoded, by the gain coefficient, the same advantageous effects as described above can be obtained.

Moreover, as another modified example of the second embodiment, at the time of performing the MDCT, the audio signals may be multiplied by a basis function multiplied by the downmix coefficients. By doing so, since the multiplication of the downmix coefficients need not be performed at the time of downmixing, the same advantageous effects as described above can be obtained.

[Third Embodiment]

An editing apparatus in accordance with a third embodiment of the present invention is an example with respect to an editing apparatus and an editing method for editing multichannel audio signals. The AAC is exemplified in the third embodiment, but it is needless to say that the present invention is not limited to the AAC.

<Hardware Configuration of Editing Apparatus>

Figure 15:
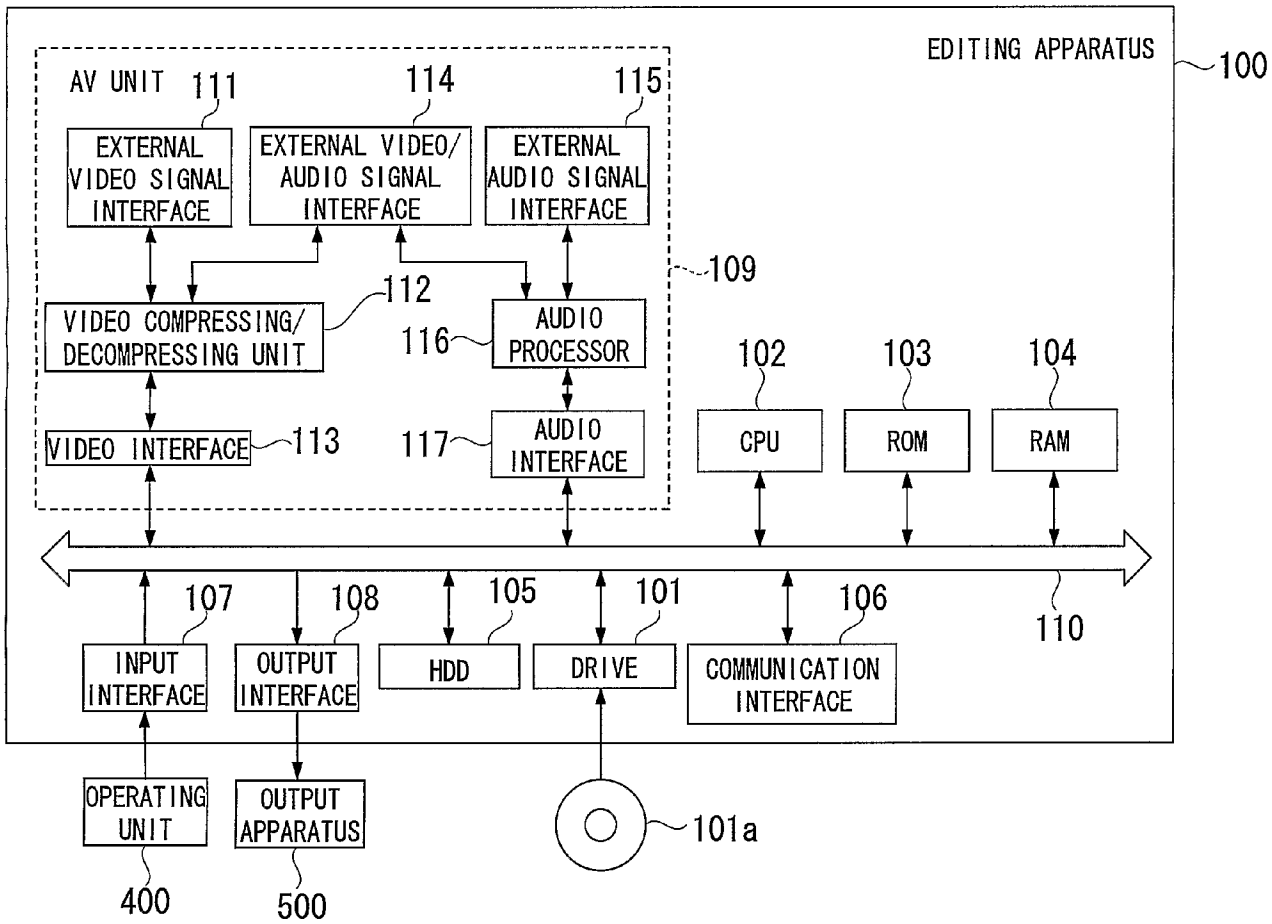
FIG. 15 is a block diagram illustrating a hardware configuration of an editing apparatus in accordance with a third embodiment of the present invention.

FIG. 15 is a block diagram illustrating a hardware configuration of the editing apparatus in accordance with the third embodiment of the present invention.

Referring to FIG. 15, an editing apparatus 100 includes a drive 101 for driving an optical disk or other recording media, a CPU 102, a ROM 103, a RAM 104, an HDD 105, a communication interface 106, an input interface 107, an output interface 108, an AV unit 109, and a bus 110 connecting these. Moreover, the editing apparatus in accordance with the third embodiment has the functions of the decoding apparatus in accordance with the first embodiment and the functions of the encoding apparatus in accordance with the second embodiment.

A removable medium 101*a* such as an optical disk is mounted on the drive 101 and data are read from the removable medium 101*a*. Although FIG. 15 shows a case in which the drive 101 is built in the editing apparatus 100, the drive 101 may be an external drive. The drive 101 may employ a magnetic disk, a magneto-optical disk, a Blu-ray disk, a semiconductor memory, etc., in addition to the optical disk. Material data may be read out from resources in a network connectable through the communication interface 106.

The CPU 102 deploys a control program recorded in the ROM 103 into a volatile memory area such as the RAM 104 and controls the entire operations of the editing apparatus 100.

The HDD 105 stores an application program as the editing apparatus. The CPU 102 deploys the application program into the RAM 104 and thus allows a computer to function as the editing apparatus. Moreover, the editing apparatus 100 can be configured such that material data, editing data of respective clips, and so forth read from the removable medium 101*a* such as an optical disk are stored in the HDD 105. Since the access speed to the material data stored in the HDD 105 is greater than that of the optical disk mounted on the drive 101, the delay of display at the time of editing is reduced by using the material data stored in the HDD 105. The storing means of the editing data is not limited to the HDD 105 as long as it is a storing means which can allow a high-speed access, and for example, a magnetic disk, a magneto-optical disk, a Blu-ray disk, a semiconductor memory, and so forth may be used. The storing means in the network connectable through the communication interface 106 may be used as the storing means for the editing data.

The communication interface 106 makes communication with a video camera connected thereto, for example, through a USB (Universal Serial Bus) and receives data recorded in a recording medium in the video camera. Moreover, the communication interface 106 can transmit the generated editing data to resources in a network through a LAN or the Internet.

The input interface 107 receives an instruction input through an operating unit 400 such as a keyboard or a mouse by a user and supplies an operation signal to the CPU 102 through the bus 110. The output interface 108 supplies image data or voice data from the CPU 102 to an output apparatus 500 such as a speaker or a display apparatus such as a LCD (Liquid Crystal Display) or a CRT.

The AV unit 109 performs a variety of processes on video signals and audio signals and includes the following elements and functions.

An external video signal interface 111 transfers video signals to/from the outside of the editing apparatus 100 and a video compressing/decompressing unit 112. For example, the external video signal interface 111 is provided with an input and output unit for analog composite signals and analog component signals.

The video compressing/decompressing unit 112 decodes and analog-converts video data supplied through a video interface 113 and outputs the resultant video signals to the external video signal interface 111. Moreover, the video compressing/decompressing unit 112 digital-converts video signals supplied from the external video signal interface 111 or an external video/audio signal interface 114 as needed, compresses the converted video signals, for example, by the MPEG-2 method, and outputs the resultant data to the bus 110 through the video interface 113.

The video interface 113 transfers data to/from the video compressing/decompressing unit 112 and the bus 110.

The external video/audio signal interface 114 outputs video data input from external equipment to the video compressing/decompressing unit 112 and outputs audio data to an audio processor 116. Moreover, the external video/audio signal interface 114 outputs video data supplied from the video compressing/decompressing unit 112 and audio data supplied from the audio processor 116 to the external equipment.

For example, the external video/audio signal interface 114 is an interface based on an SDI (Serial Digital Interface) and so forth.

An external audio signal interface 115 transfers audio signals to/from the external equipment and the audio processor 116. For example, the external audio signal interface 115 is an interface based on the interface standard of analog audio signals.

The audio processor 116 analog-digital converts audio signals supplied from the external audio signal interface 115 and outputs the resultant data to an audio interface 117. Moreover, the audio processor 116 performs the digital-to-analog conversion, voice adjustment, and so forth on audio data supplied from the audio interface 117 and outputs the resultant signals to the external audio signal interface 115.

The audio interface 117 supplies data to the audio processor 116 and outputs data from the audio processor 116 to the bus 110.

<Functional Configuration of Editing Apparatus>

Figure 16:
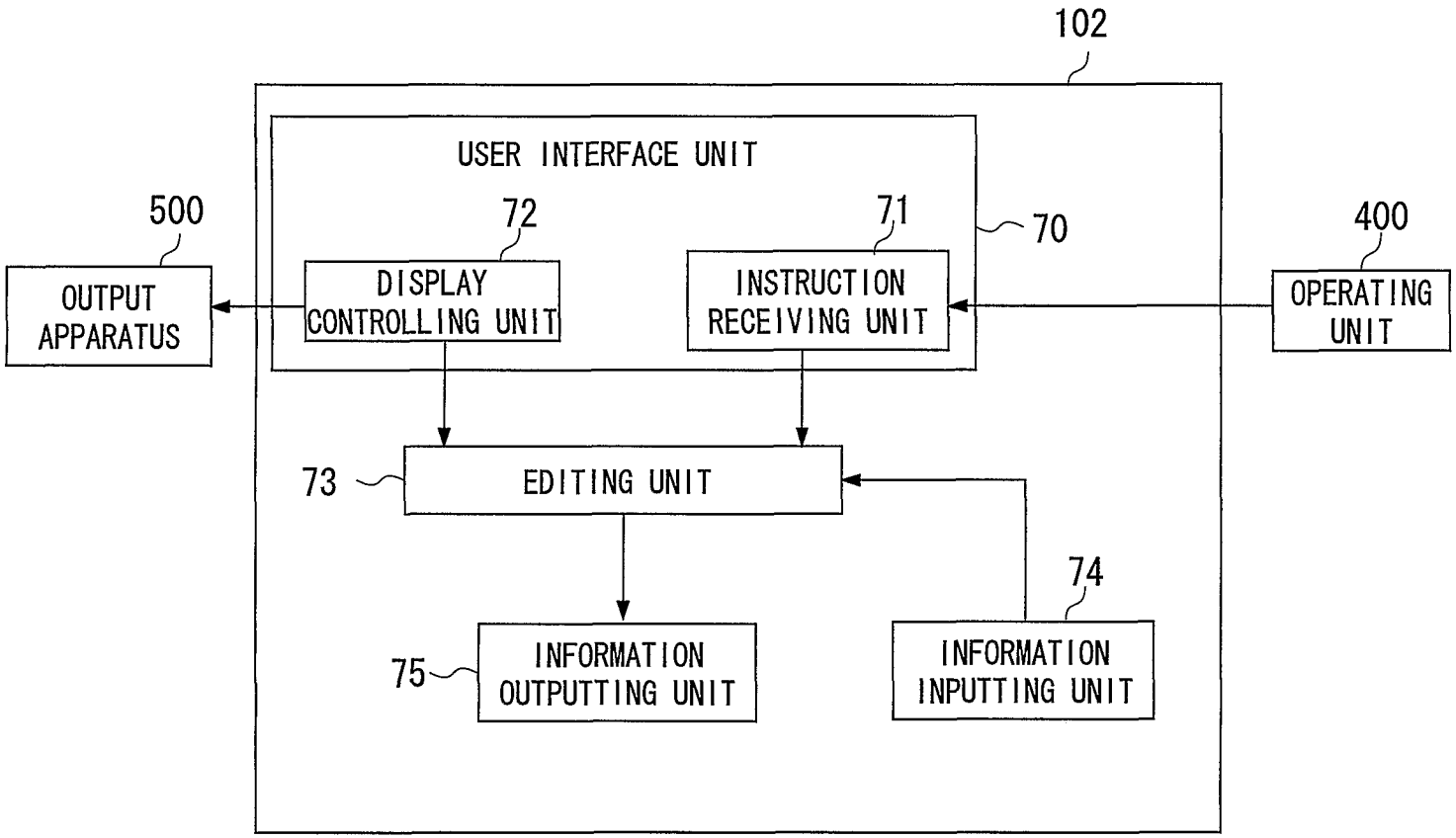
FIG. 16 is a functional configuration diagram of the editing apparatus in accordance with the third embodiment.

FIG. 16 is a functional configuration diagram of the editing apparatus in accordance with the third embodiment.

Referring to FIG. 16, the CPU 102 of the editing apparatus 110 constructs respective functional blocks of a user interface unit 70, an editing unit 73, an information inputting unit 74, an information outputting unit 75 by the use of an application program deployed in the memory.

The respective functional blocks embody an import function of a project file including material data and editing data, an editing function of respective clips, an export function of a project file including material data and/or editing data, a margin setting function for material data at the time of exporting the project file, and so forth. Hereinbelow, the editing function will be described in detail.

<Editing Function>

Figure 17:
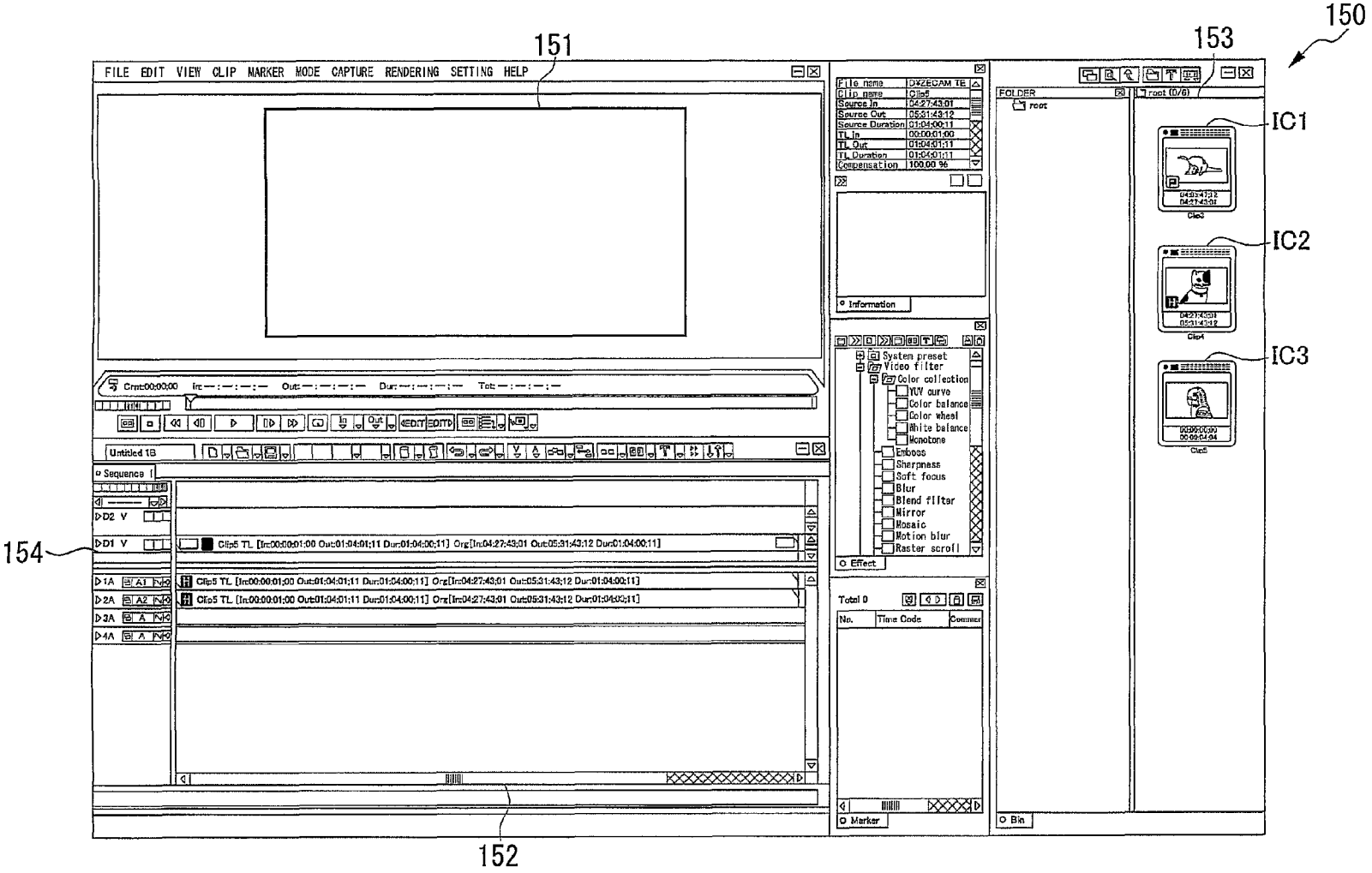
FIG. 17 is a diagram illustrating an example of an edit screen of the editing apparatus.

FIG. 17 is a diagram illustrating an example of an edit screen of the editing apparatus.

Referring to FIG. 17 together with FIG. 16, display data of the edit screen is generated by a display controlling unit 72 and is output to the display of the output apparatus 500.

The edit screen 150 includes a reproduction window 151 which displays a reproduction screen of edited contents or acquired material data, a time line window 152 configured by a plurality of tracks in which the respective clips are arranged along time lines, a bin window 153 which displays the acquired material data by the use of icons and so forth.

The user interface unit 70 includes an instruction receiving unit 71 which receives an instruction input through the operating unit 400 by a user and the display controlling unit 72 which performs the display control on the output apparatus 500 such as a display or a speaker.

The editing unit 73 acquires, through the information inputting unit 74, material data referred to by a clip designated by the instruction input through the operating unit 400 from the user or material data referred to by a clip having project information designated as a default.

When material data recorded in the HDD 105 is designated, the information inputting unit 74 displays an icon in the bin window 153, and when material data which is not recorded in the HDD 105 is designated, the information inputting unit 74 reads the material data from the resources in the network or the removable medium and displays an icon in the bin window 153. In the illustrated example, three pieces of material data are displayed by icons IC1 to IC3.

The instruction receiving unit 71 receives on the edit screen the designation of clips used in the editing, the reference range of the material data, and the temporal positions in the time axis of contents occupied by the reference range. Specifically, the instruction receiving unit 71 receives the designation of clip IDs, the start point and the temporal length of the reference range, time information on contents in which the clips are arranged, and so forth. To this end, the user drags and drops the icon of desired material data on the time line using the displayed clip names as a clue. The instruction receiving unit 71 receives the designation of a clip ID by this operation, and thus the selected clip with the temporal length corresponding to the reference range referred to by the selected clip is arranged on the track. arrangement on the time line of the clip arranged on the track can be sui The start point, the end point, and the temporal tably changed, and an instruction can be input by, for example, moving a mouse cursor on the edit screen and doing a predetermined operation.

For example, the editing of an audio material is performed as follows. When a user designates a 5.1-channel audio material of the AAC format recorded in the HDD 105 by the use of the operating unit 400, the instruction receiving unit 71 receives the designation and the editing unit 73 displays an icon (clip) in the bin window 153 on the display of the output apparatus 500 through the display controlling unit 72.

When the user instructs to arrange the clip on an audio track 154 of the time line window 152 by the use of the operating unit 400, the instruction receiving unit 71 receives the designation and the editing unit 73 displays the clip in the audio track 154 on the display of the output apparatus 500 through the display controlling unit 72.

When the user selects, for example, downmixing to stereo from among editing contents displayed by a predetermined operation by the use of the operating unit 400, the instruction receiving unit 71 receives an instruction for the downmixing to stereo (an editing process instruction) and notifies the editing unit 73 of this instruction.

The editing unit 73 downmixes the 5.1-channel audio material of the AAC format to generate a two-channel audio material of the AAC format in accordance with the instruction notified from the instruction receiving unit 71. At this time, the editing unit 73 may perform the decoding method in accordance with the first embodiment to generate downmixed decoded stereo audio signals, or the editing unit 73 may perform the encoding method in accordance with the second embodiment to generate downmixed encoded stereo audio signals. Moreover, both methods may be performed substantially at the same time.

The audio signals generated by the editing unit 73 are output to the information outputting unit 75. The information outputting unit 75 outputs an edited audio material to, for example, the HDD 105 through the bus 110 and records the edited audio material therein.

It is to be noted that when an instruction to reproduce a clip on the audio track 154 is given by the user, the editing unit 73 may output and reproduce the downmixed decoded stereo audio signals while downmixing the 5.1-channel audio material by the above-mentioned decoding method as if it reproduced a downmixed material.

<Editing Method>

Figure 18:
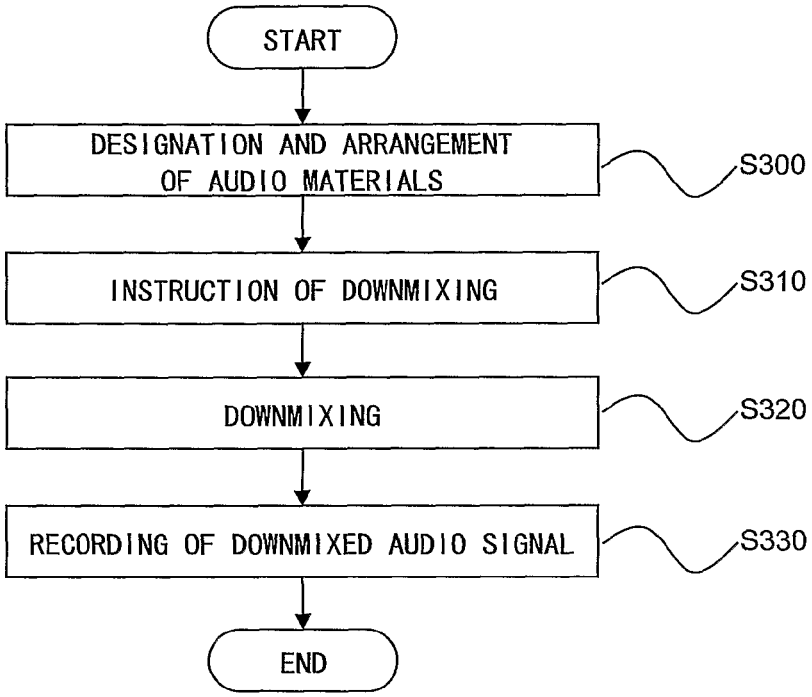
FIG. 18 is a flowchart illustrating an editing method in accordance with the third embodiment of the present invention.

FIG. 18 is a flowchart illustrating an editing method in accordance with the third embodiment of the present invention. The editing method in accordance with the third embodiment of the present invention will be described with reference to FIG. 18 using an example in which 5.1-channel audio signals are edited.

First, in step S300, when a 5.1-channel audio material of the AAC format recorded in the HDD 105 is designated by the user, the CPU 102 receives the designation and displays the audio material as an icon in the bin window 153. Furthermore, when an instruction to arrange the displayed icon on the audio track 154 in the time line window 152 is given by the user, the CPU 102 receives the instruction and arranges the clip of the audio material on the audio track 154 in the time line window 152.

Subsequently, in step S310, when, for example, downmixing to stereo for the audio material is selected from among the editing contents displayed by the predetermined operation through the operating unit 400 by the user, the CPU 102 receives the selection.

Subsequently, in step S320, the CPU 102 having received the instruction for the downmixing to stereo downmixes the 5.1-channel audio material of the AAC format to generate two-channel stereo audio signals. At this time, the CPU 102 may perform the decoding method in accordance with the first embodiment to generate a downmixed decoded stereo audio signals, or the CPU 102 may perform the encoding method in accordance with the second embodiment to generate a downmixed encoded stereo audio signals. The CPU 102 outputs the audio signals generated in step S320 to the HDD 105 through the bus 110 and records the generated audio signals therein (step S330). It is to be noted that the audio signals may be output to an apparatus external to the editing apparatus, instead of recording them in the HDD.

In accordance with the third embodiment, even in the editing apparatus that can edit the audio signals, the same advantageous effects as the first and second embodiments can be obtained.

Although preferred embodiments of the present invention have been described above in detail, the present invention is not limited to such particular embodiments, but various modifications may be made within the scope of the present invention recited in the claims.

For example, the downmixing of the audio signals is not limited to the downmixing to stereo, but the downmixing to monaural may be performed. Moreover, the downmixing is not limited to the 5.1-channel downmixing, but as an example, a 7.1-channel downmixing may be performed. More specifically, in 7.1-channel audio systems, there are, for example, two channels (a left back channel (LB) and a right back channel (RB)) in addition to the same channels as those in the 5.1 channels. When 7.1-channel audio signals are downmixed to 5.1-channel audio signals, the downmixing can be performed in accordance with Equations (9) and (10).

$$LSDM=\alpha LS+\beta LB \tag{9}$$

$$RSDM=\alpha RS+\beta RB \tag{10}$$

In Equation (9), LSDM represents a left surround channel audio signal, after being downmixed, LS represents a left surround channel audio signal, before being downmixed, and LB represents a left back channel audio signal. In Equation (10), RSDM represents a right surround channel audio signal, after being downmixed, RS represents a right surround channel audio signal, before being downmixed, and RB represents a right back channel audio signal. In Equations (9) and (10), $\alpha$, and $\beta$ represent downmix coefficients.

The left surround channel audio signal and the right surround audio channel signal generated in accordance with Equations (9) and (10) and the center channel audio signal, the left channel audio signal, and the right channel audio signal not used in the downmixing construct the 5.1-channel audio signals. It is to be noted that similar to the method for downmixing the 5.1-channel audio signals to the two-channel audio signals, the 7.1-channel audio signals may be downmixed to two-channel audio signals.

Moreover, although the AAC has been exemplified in the above-mentioned embodiments, it is needless to say that the present invention is not limited to the AAC but can be applied to a case in which a codec using window functions in time-frequency transformation such as MDCT of AC3, ATRAC3, and so forth is employed.

The invention claimed is:

1. A decoding apparatus comprising:

a channel decoder comprising:

a storing means for storing encoded audio signals including multi-channel audio signals;

a transforming means for transforming the encoded audio signals to generate transform block-based audio signals in a time domain;

a window processing means for multiplying the transform block-based audio signals by a second window function, wherein the second window function is a product of a mixture ratio of the audio signals and a first window function; and a synthesizing means for overlapping the multiplied transform block-based audio signals to synthesize multi-channel audio signals; and a mixing means for mixing the synthesized multi-channel audio signals between channels to generate a downmixed audio signal without multiplying the synthesized multi-channel audio signals using a mixture ratio, wherein the mixing occurs after multiplying the transform block-based audio signals by the second window function.

2. The decoding apparatus as recited in claim 1, wherein the first window function is normalized.

3. The decoding apparatus as recited in claim 1, wherein the mixing means transforms the synthesized multi-channel audio signals to audio signals of a smaller number of channels than the number of channels included in the encoded audio signals.

4. The decoding apparatus as recited in claim 1, wherein the encoded audio signals are audio signals for a 5.1-channel or 7.1-channel audio system, and wherein the mixing means generates a stereo audio signal or a monaural audio signal.

5. A decoding apparatus comprising:

a memory storing encoded audio signals including multi-channel audio signals; and a CPU, wherein the CPU is configured to comprise:

a channel decoder configured to:

transform the encoded audio signals to generate transform block-based audio signals in a time domain, multiply the transform block-based audio signals by a second window function, the second window function being a product of a mixture ratio of the audio signals and a first window function, and overlap the multiplied transform block-based audio signals to synthesize multichannel audio signals, and a mixing unit configured to mix the synthesized multi-channel audio signals between channels to generate a downmixed audio signal without multiplying the synthesized multi-channel audio signals using a mixture ratio, wherein the CPU is configured to mix the synthesized multi-channel audio signals after multiplying the transform block-based audio signals by the second window function.

6. The decoding apparatus as recited in claim 5, wherein the CPU is configured to generate a mixed audio signal including a smaller number of channels than the number of channels included in the encoded audio signals.

7. The decoding apparatus as recited in claim 5, wherein the encoded audio signals are audio signals for a 5.1-channel or 7.1-channel audio system, and wherein the CPU is configured to generate a stereo audio signal or a monaural audio signal.

8. An encoding apparatus comprising:

a storing means for storing multi-channel audio signals;

a mixing means for mixing the multi-channel audio signals between channels to generate a downmixed audio signal without multiplying the synthesized multi-channel audio signals using a mixture ratio, wherein a portion of the multi-channel audio signals are multiplied by downmix coefficients to generate the downmixed audio signal; and a channel encoder including:

a separating means for separating the downmixed audio signal to generate transform block-based audio signals;

a window processing means for multiplying the transform block-based audio signals by a product of a mixture ratio of the audio signals and a first window function, the product being a second window function; and a transforming means for transforming the multiplied audio signals to generate encoded audio signals.

9. The encoding apparatus as recited in claim 8, wherein the mixing means comprises:

a multiplying means for multiplying an audio signal of a first channel by a product of a first mixture ratio ($\delta,\beta$) associated with the first channel and a reciprocal of a second mixture ratio ($\alpha$) associated with a second channel, the product being a third mixture ratio ($\delta/\alpha$, $\beta/\alpha$); and an adding means for adding the audio signals of multiple channels including the first channel and the second channel, and wherein the window processing means multiplies the transform block-based audio signals by the second window function which is a product of the second mixture ratio and the first window function.

10. The encoding apparatus as recited in claim 8, wherein the first window function is normalized.

11. The encoding apparatus as recited in claim 8, wherein the mixing means transforms the multi-channel audio signals to audio signals of a smaller number of channels.

12. An encoding apparatus comprising:

a memory storing multi-channel audio signals; and a CPU, wherein the CPU is configured to comprise:

a mixing unit configured to mix the multi-channel audio signals between channels to generate a downmixed audio signal without multiplying the synthesized multi-channel audio signals using a mixture ratio, wherein a portion of the multi-channel audio signals are multiplied by downmix coefficients to generate the downmixed audio signal, and a channel encoder configured to:

separate the downmixed audio signal to generate transform block-based audio signals, multiply the transform block-based audio signals by a product of a mixture ratio of the audio signals and a first window function, the product being a second window function, and transform the multiplied audio signals to generate encoded audio signals.

13. The encoding apparatus as recited in claim 12, wherein the CPU is configured to mix the multi-channel audio signals to generate audio signals of a smaller number of channels.

14. The decoding apparatus of claim 1, wherein the transform is an inverse modified discrete cosine transform.

15. The decoding apparatus of claim 5, wherein the transform is an inverse modified discrete cosine transform.

16. The encoding apparatus of claim 8, wherein the transform is modified discrete cosine transform.

17. The encoding apparatus of claim 12 wherein the transform is a a modified discrete cosine transform.

* * * * *